US005394722A

United States Patent [19]

Meyer

[11] Patent Number: 5,394,722

[45] Date of Patent: Mar. 7, 1995

[54] APPARATUS FOR FORMING PROFILES ON STRIP MATERIALS

[76] Inventor: Bruce E. Meyer, 17837 W. Lunnonhaus Dr., Apt. #4, Golden, Colo. 80401

[21] Appl. No.: 108,971

[22] Filed: Aug. 17, 1993

[51] Int. Cl.[6] ..... B21D 5/08

[52] U.S. Cl. ..... 72/129; 72/180; 72/181; 72/247

[58] Field of Search ..... 72/181, 180, 179, 182, 72/247, 129

[56] References Cited

U.S. PATENT DOCUMENTS

| | | | |
|---|---|---|---|
| 1,346,899 | 7/1920 | Bombard . | |
| 1,414,340 | 5/1922 | Crowe . | |
| 2,352,675 | 7/1944 | Yoder . | |
| 2,505,241 | 4/1950 | Gray et al. . | |
| 2,569,266 | 9/1951 | Thompson . | |
| 2,794,409 | 6/1957 | Freeze . | |
| 2,826,235 | 3/1958 | Gudmestad . | |
| 2,912,038 | 11/1959 | Harper . | |
| 2,931,277 | 5/1960 | Bombard . | |
| 3,183,701 | 5/1965 | Cain, Jr. . | |
| 3,319,448 | 5/1967 | Bottom . | |
| 3,394,524 | 7/1968 | Howarth . | |
| 3,529,461 | 9/1970 | Knudson . | |
| 3,595,056 | 7/1971 | Hutton . | |
| 3,791,185 | 2/1974 | Knudson . | |
| 3,815,398 | 6/1974 | McClain | 72/181 |
| 3,886,779 | 6/1975 | McClain | 72/181 |
| 3,898,783 | 8/1975 | Matlock et al. | 52/529 |
| 4,120,123 | 10/1978 | Knudson | 52/86 |
| 4,269,055 | 5/1981 | Sivachenko et al. | 72/181 |
| 4,471,641 | 9/1984 | Mitchell | 72/181 |
| 4,487,046 | 12/1984 | Abbey, III | 72/181 |
| 4,495,743 | 1/1985 | Ellison et al. | 52/478 |
| 4,505,143 | 3/1985 | Knudson | 72/181 |
| 4,597,234 | 7/1986 | Simpson | 52/478 |
| 4,660,399 | 4/1987 | Suter et al. | 72/181 |
| 4,716,754 | 1/1988 | Youngs | 72/181 |
| 4,721,504 | 1/1988 | Cogswell et al. | 493/440 |
| 4,787,233 | 11/1988 | Beymer | 72/181 |
| 4,878,331 | 11/1979 | Taylor | 52/519 |
| 4,899,566 | 2/1990 | Knudson | 72/181 |
| 4,947,671 | 8/1990 | Lindstrom | 72/181 |
| 5,072,563 | 12/1991 | Menegoli | 52/537 |
| 5,140,793 | 8/1992 | Knudson | 52/520 |
| 5,148,694 | 9/1992 | Pearson et al. | 72/181 |

FOREIGN PATENT DOCUMENTS

| | | | |
|---|---|---|---|
| 1777039 | 10/1971 | Germany | 72/181 |
| 257 | 3/1882 | Italy | 72/180 |
| 55-100826 | 8/1980 | Japan . | |
| 27723 | 2/1984 | Japan | 72/181 |

*Primary Examiner*—Daniel C. Crane
*Attorney, Agent, or Firm*—Timothy J. Martin

[57] ABSTRACT

A roll forming device receives a continuous elongated flat sheet of metal to form selected profiles along at least one longitudinal margin thereof. The roll forming device comprises a drive assembly, located within the apparatus frame which engages the elongated sheet proximate to the entryway and advances the sheet in a downstream direction discharge it at an exit. Preferably, at least one guide bar is supported by the frame which also engages the longitudinal margin of the sheet as it is advanced downstream and bends it into a trough-shaped cross-section. The frame houses at least one forming station having a coacting pair of first and second forming rollers journaled for rotation about respective axes. Some of the forming stations may include a plurality of pairs of coacting first and second forming rollers, at least some of which are mounted to be adjustably positioned toward and apart from one another to accommodate varying widths of sheet metal. Optional features may include a rotatable reel assembly operative to mount and feed a continuous coil of material, and a sub-frame for supporting an assemblage of forming stations which is adjustable in three dimensions.

44 Claims, 12 Drawing Sheets

APPARATUS FOR FORMING PROFILES ON STRIP MATERIALS

FIELD OF THE INVENTION

The present invention generally relates to material forming machines, but more particularly relates to forming machines wherein a strip of material is advanced through the machine against forming elements in order to progressively shape the strip of material into a desired cross-sectional configuration. Specifically, the present invention concerns metal forming apparatus that receives an elongate strip of material, either as a panel or from a continuous coil, to fabricate a shaped member for the construction industry. This invention is particularly concerned with a single machine that can make substantially geometrically similar cross-sections of at least two different dimensions.

BACKGROUND OF THE INVENTION

Material fabricating machines occupy a significant role in modern industry and include, for example, machines which stamp, roll, form, cut and extrude various materials, to name a few available production techniques. One such type of machine, and a type to which the present invention is directed, receives an elongated strip of material at an entryway, advances the strip of material progressively through the machine and against laterally positioned forming elements to configure one or more longitudinal margins of the strip into desired useful cross-sections after which the strip is then discharged at an exit location. The material strips may be fed into such a machine either in discrete lengths or, as more is more typically the case, as a continuous fed from a coil. The formed strip is then cut into usable lengths by a shearing assembly after the formed member exits the machine. This type of machine is widely used to fabricate metal strips into useful shaped members such as gutter, roof panels, siding panels, etc.

Existing apparatus for fabricating elongated metal strips typically have a framework which supports a drive system for advancing the strip of metal through the machine, and machine forming elements are disposed along the pathway of the strip to configure the longitudinal margins of the strip into desired profiles. Normally in these machines, the profile forming elements are each independently mounted to the framework at selected locations so that the longitudinal margin of the strip is progressively bent into the desired shape. Sometimes, however, groups of forming elements are mounted together in forming station sets, for example, as described in the co-pending patent application, Ser. No. 07/909,362 by Coben et al. filed Jul. 6, 1992. Other examples may be found in U.S. Pat. No. 4,947,671 issued Aug. 14, 1990 to Lindstrom and U.S. Pat. No. 3,319,448 issued May 16, 1967 to Bottom.

Various drive assemblies are described in prior patents and are disclosed, for example, in the following list of patents:

| Patent No. | Inventor | Issued |
|---|---|---|
| 1,346,899 | Bombard | July 20, 1920 |
| 2,569,266 | Thompson | Sept. 25, 1951 |
| 2,931,277 | Bombard | April 5, 1960 |
| 3,319,448 | Bottom | May 16, 1967 |
| 4,721,504 | Cogswell | Jan. 26, 1988 |

-continued

| Patent No. | Inventor | Issued |
|---|---|---|
| 4,899,566 | Knudson | Feb. 13, 1990 |

Furthermore, it is well known to use a variety of different types of forming rollers to produce different profiles. Examples of such fabrication machines, in addition to the above reference patents, may be found in the following references:

| Patent No. | Inventor | Issued |
|---|---|---|
| 2,826,235 | Gudmestad | March 11, 1958 |
| 3,595,056 | Hutton | July 27, 19711 |
| 3,815,398 | McClain | June 11, 1974 |
| 4,487,046 | Abbey | Dec. 11, 1984 |
| 4,505,143 | Knudson | March 19, 1985 |
| 4,716,754 | Youngs | Jan. 5, 1988 |
| 4,787,233 | Beymer | Nov. 29, 1988 |

While all of these existing machines are quite useful and effective in fabricating metal strips into shaped members, such as panels and gutters, each machine typically can only form a single profile so that a fabricator must acquire a separate machine for each profile desired to be configured. Alternatively, the entire set of forming elements may be replaced by individually detaching each forming element or, in certain cases, by replacing a forming station box comprising a set of forming rollers. Even where individual forming elements are replaced, the fabricator is still constrained to produce panels of a defined width since the forming elements are attached to discrete positions. Thus, where a fabricator wishes to manufacturer custom widths or a variety of standard widths, additional machines must be acquired or extensive modifications must be made to an existing machine. These machines are also quite bulky in size and weight so that they often require fabrication of the formed panels at a location remote from a construction site or use of a separate trailer for transport to the on-site location.

Accordingly, there remains a need for improved material forming machines which can receive an elongated strip of material to create a useful cross-section so that usable shaped members may be produced. There is further a need for machines having reduced bulk so that they can be easily transported to on-site locations. A further need remains for machines which can quickly be adjusted to create geometrically similar profiles of different dimensions.

SUMMARY OF THE INVENTION

It is an object of the present invention to provide a new and useful apparatus for forming elongated strips of material into a desired cross-section by creating a profile on one or more of the marginal longitudinal edges of the strip of material as it is advanced through the apparatus.

Another object of the present invention is to provide an apparatus of reduced weight and size but capable of efficiently fabricating elongated strips of material, such as metal, and which is transportable, for example, by a standard sized struck, to an on-site location.

Another object of the present invention is to provide an apparatus for fabricating profiles onto elongated strips of material which can be adjusted quickly to produce somewhat geometrically similar profiles of different dimensions.

Yet another object of the present invention is to provide an apparatus for forming profiles on one or both margins of an elongated strip of material that reduces the longitudinal dimension of the apparatus by prebending the material into a trough-shaped configuration prior to presentation to forming roller stations that produce a profile on the longitudinal margin or margins.

Still a further object of the present invention is to provide a metal forming machine which can receive a plurality of coils of materials, for example of different color, for fabricating different colored-shaped members.

Another object of the present invention is to provide an apparatus which can mount a coil of material having oppositely color surfaces so that the coil may be pivoted between two rotational positions whereby the exterior surface of a shaped member may be formed either of the selected two colors.

Still another object of the present invention is to provide a material forming apparatus which has forming rollers that are quickly and easily adjustable for yaw pitch and roll.

Yet another object of the present invention is to provide a gutter forming machine can produce standard ogee-shaped gutters of at least two differently sized cross-section.

According to the present invention, then, an apparatus is adapted for forming elongated flat sheets of formable material into shaped members having a selected profile along at least one longitudinal margin thereof. The apparatus broadly includes a frame that supports a drive assembly with the frame having an entryway at a first end and an exit at the second end so that the drive assembly advances the elongated sheet longitudinally in a downstream direction to discharge the elongated sheet, as a formed member, at the exit. In order to form the longitudinal margin of the stock material, a plurality of forming stations are located laterally of the drive assembly and are operative to engage a longitudinal edge portion of the elongated sheet so that each forming station progressively configures the margin into the desired profile as the margin is sequentially advanced through the forming stations. Each forming station includes a co-acting pair of first and second forming rollers journaled for rotation about first and second axis, respectively with the forming roller disposed on opposite sides of a forming plane within which the marginal portion is oriented.

In the exemplary embodiment of the present invention, a first guide bar is supported by the frame and is disposed laterally of the drive assembly. The first guide bar is operative to engage a first margin of the elongated sheet in order to deflect the margin so that the elongated sheet is bent into a trough-shaped cross-section with the first margin being positioned in a first forming plane that is oriented at first angle with respect to a central portion of the elongated sheet engaged by the drive assembly. Preferably, the angle of the first forming plane is within a range of 20° to 40° and may be selected to be approximately 40°. Preferably, a second guide bar is supported by the frame and is disposed laterally of the drive assembly on a side thereof opposite the first guide bar. This second guide bar is operative to engage a second margin of the elongated sheet as it is advanced in the downstream direction and is operative to deflect the second margin at a second angle so that the central portion of the elongated sheet forms a bottom for the trough-shaped cross-section. The second guide bar is constructed to deflect the second margin at an increasingly larger second angle as the elongated sheet is advanced in the downstream direction.

While the present invention contemplates a single forming station, it is preferred that a plurality of forming stations be provided with each forming station including at least one pair of co-acting first and second forming rollers journaled for rotation on first and second axis, respectively, on opposite sides of the forming plane. At least some of the first and second forming axis are oriented generally parallel to the forming plane and at least some of the forming stations preferably include a plurality of pairs of co-acting first and second forming rollers. Where a plurality of pairs of co-acting first and second forming rollers are provided, some of the first rollers are preferably journaled for rotation on a common first axes and some of the second rollers are journaled for rotation on the common second axes. In such case, it is further preferred that at least two of the first rollers located on the common first axes are adjustable so that they may be positioned toward and apart from one another different distances so as to define at least two relative positions thereby allowing selective variance of the profile to be formed. Likewise, it is preferred that at least two of the second rollers are correspondingly adjustably mounted so that they may be positioned toward and apart from one another for selected spacing. Here, a mechanical linkage is provided to interconnect the first and second rollers for common selected positioning.

To accomplish the slidable positioning preventing the selected spacing of the adjustable rollers with respect to one another, it is preferred that the adjustable first rollers be mounted on a common first axle while the adjustable second rollers are rotatably journaled on a common second axle. These axles may extend between a pair of support plates with a first one of adjustable rollers having a fixed relative axial position and a second one of the adjustable rollers being axially slideable on the respective axle. Preferably, each axle has an axially bore at one end sized to matably receive an axially post disposed on and projecting from a first one of the support plates with the first axle then being slideably mounted in a second one of the support plates. A movable crosspiece is secured to a second one of the first rollers and is movable with respect to the second support plate. A limit stop is provide on the first axle so that the crosspiece will axially move the second one of the first rollers until the crosspiece engages the limit stop and thereafter will slidably move the first axle with respect to the axially post.

Entry guide brackets are provided at the entryway and are adjustable to selectively vary the width therebetween in order to accommodate different widths of the elongated material. The entryway guides feed the elongated sheet into the drive assembly, and one or more skate assemblies and platen roller assemblies are operative to engage opposite surfaces of the central portion of the elongated sheet as it is advanced in the downstream direction. The skate and platen roller assemblies also help to form the desired profiles on the marginal edges. The elongated sheet may be fed off of a continuous coil, and the shaped members may be cut to length by a shear assembly located at the downstream exit. Where a continuous coil is used, a reel assembly mounts the coil. Preferably, the reel assembly is rotatable so that it may be positioned at two positions allowing inversion of the sheet when fed into the drive assembly. The reel assembly may have a pair of spool supports adapted to engage and support ends of the coil with the spool supports being slidably positionable on a reel axle to accommodate different widths of material. Here, a detent may be provided to selectively retain at least one of the spool supports at a selected position along the reel axle.

The forming stations may be discrete, or may be organized in groups or assemblages supported on a common sub-frame that is in turn mounted to the frame. Here, adjustable sub-frame mounts are operative to secure the common sub-frame to the main frame, and the sub-frame mounts from an adjustment in an "x" axes and a "y" axes that are transverse to the downstream direction whereby the yaw and pitch of the sub-frame may be selectively varied. Furthermore, the sub-frame mounts may permit slight rotational rotation adjustment about a "z" axes that is perpendicular to the "x" and "y" axis whereby the roll of the sub-frame may be selectively varied.

The drive assembly may be a chain and sprocket type driven by a motor and gear box assembly. Various drive axles and gears are arranged to drive upper and lower gear axles which respectively engage upper and lower drive rollers. Here, the driver rollers are organized as drive roller assemblies, each having an upper and lower roller that are geared together for corresponding counter-rotation.

These and other objects of the present invention will become more readily appreciated and understood from a consideration of the following detailed description of the exemplary preferred embodiment when taken together with the accompanying drawings, in which:

DETAILED DESCRIPTION OF THE EXEMPLARY EMBODIMENT

The present invention is directed to forming apparatus especially adapted to fabricate shaped members out of elongated flat sheets of formable material which may be fed into the machine either off of a continuous coil or as discrete elongated panels. In particular, the present invention is useful to fabricate metal panels to form profiles on one or both longitudinal edge margins thereof, for example, for use as roof panels, siding, gutters and the like. While the structure of the present invention may be employed to produce a wide variety of structural members, the exemplary embodiment of the present invention is described with respect to a machine for forming gutters of the ogee-type and, as described more thoroughly below, may be used to produce gutters of similar cross-section but two different dimensional sizes by simple adjustment. It should be understood, however, that the present invention is not limited merely to forming machines for producing gutters but rather to other machines having different edge profiles.

Figure 1:
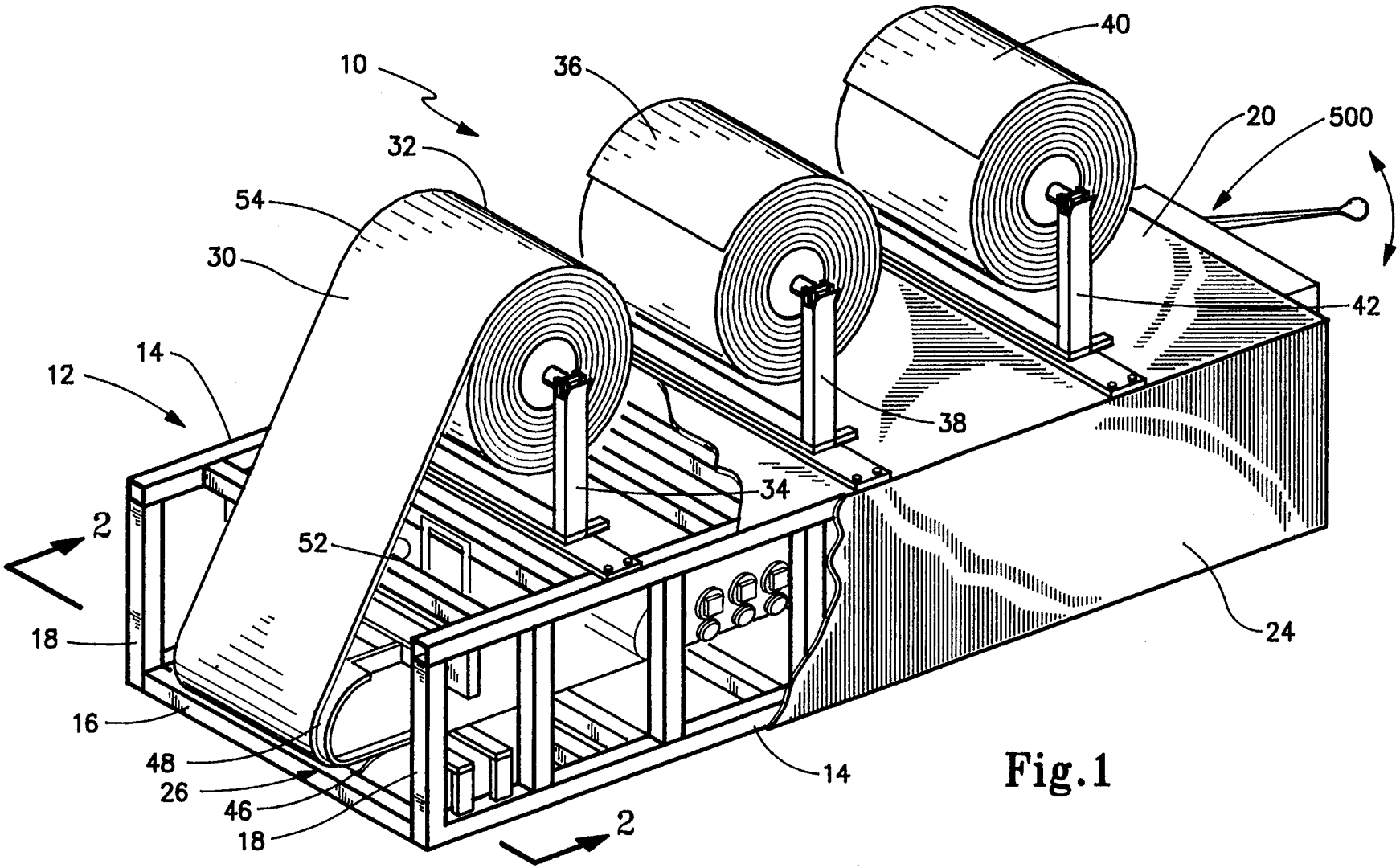
FIG. 1 is a perspective view of the forming apparatus according to the exemplary embodiment of the present invention.
Figures 2, 3:
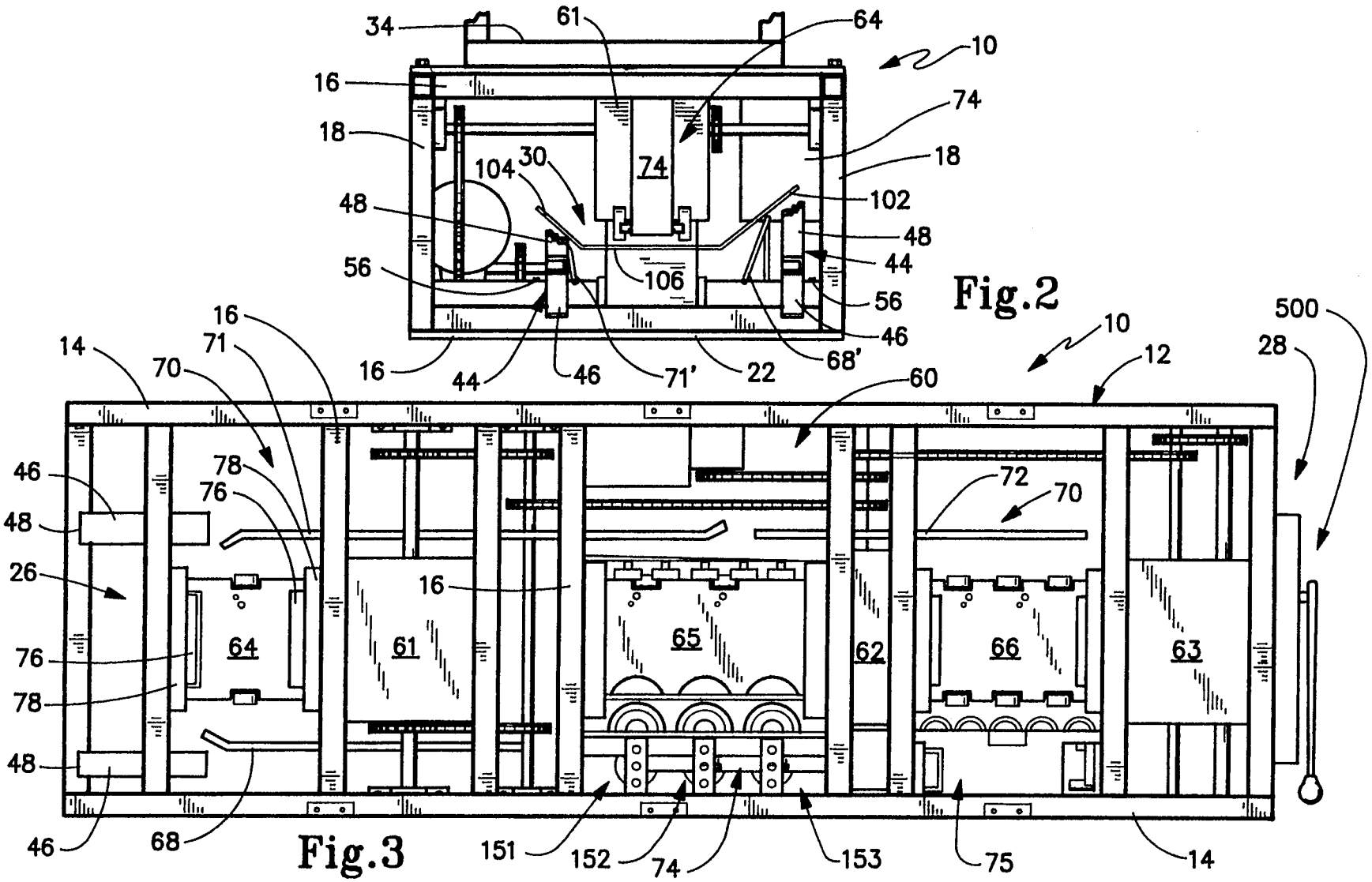
FIG. 2 is a view taken along lines 2—2 of FIG. 1.
FIG. 3 is a top plan view of the forming apparatus of FIGS. 1 and 2 with the top panels and reel assemblies removed therefrom.
Figure 5:
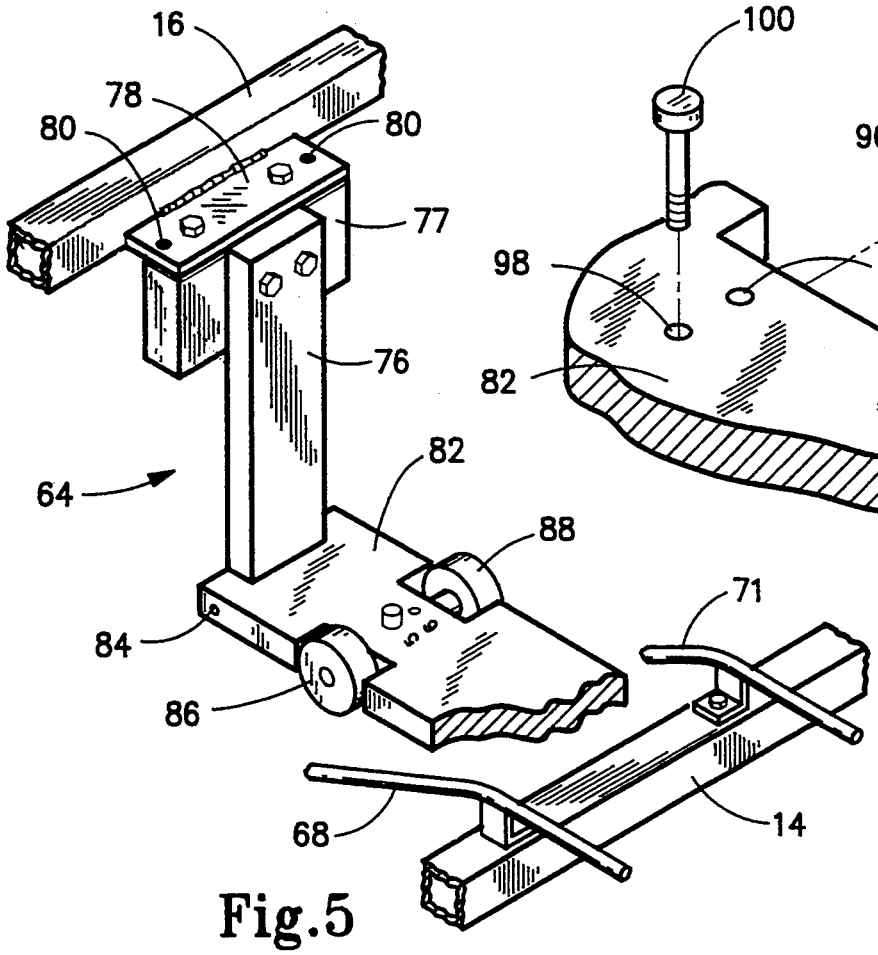
FIG. 5 is a perspective view, partially broken-away of the first skate assembly, first guide bar and second guide bar shown in FIGS. 2–4.

By way of explanation, then, a representative forming apparatus according to the present invention is shown in FIGS. 1–3. Here, forming apparatus 10 is in the form of a machine adapted to fabricate gutters, particularly of the ogee-type. Apparatus 10 includes a frame 12 formed of a plurality of longitudinally extending beams 14, transverse beams 16 and upright beams 18. Frame 12 is enclosed by a top panel 20, a bottom panel 22 and side panels, such as side panel 24. Forming apparatus 10 has an entryway 26 located at a first or upstream end into which an unformed sheet may be inserted; an exit 28 is located at a second end of frame 12 opposite entryway 26.

As is shown in FIG. 1, forming apparatus 10 is adapted to receive an elongated sheet of material, such as metal, to be formed into a shaped member that may be used, for example, in the construction industry. In FIG. 1, an elongated sheet 30 is shown being fed into entryway 26 from a continuous coil 32 mounted to frame 12 by means of a reel assembly 34. First and second auxiliary coils 36, 40 are respectively journaled for rotation and dispensing from reel assemblies 38 and 42, respectively. With reference to FIGS. 1–4, it may be seen that entryway guides are provided to direct sheet 30 into engagement with a drive assembly which in turns operates to advance the elongated sheet longitudinally in a downstream direction from entryway 26 to exit 28. More particularly, each entry guide 44 includes a guide channel 46, an upwardly extending arcuate guide shoe 48 and a downwardly depending arcuate guide foot 50. Guide channels 46 have opposed, facing channels sized to receive edges 52 and 54 of sheet 30. Entry guides 44 are mounted by means of brackets 56 which may be secured by nut and bolt assemblies to selected mounting locations so that the effective distance between entry guides 44 may be adjusted to accommodate different widths of sheet material 30.

The various component assemblies which comprise forming apparatus 10 are best shown in FIG. 3. In FIG. 3, it may be seen that forming apparatus 10 includes a drive assembly 60 that is described in greater detail with reference to FIG. 22, below, and drive assembly 60 includes a plurality of drive stations 61–63. Skate assemblies 64–66 extend upstream from each roller assemblies 61–63, respectively. A first guide bar 68 extends longitudinally in frame 12 alongside roller assembly 61 and a second guide bar assembly 70, formed by guide bar sections 71 and 72 extends longitudinally opposite first guide bar 68. A first group of forming stations in the form of forming roller box 74 and a second forming box 75 are disposed in a frame 12 proximate to skate assemblies 65 and 66, respectively.

With reference to FIGS. 2–8, it may be seen that first skate assembly 64 is suspended from a pair of transverse beams 16, 16′ by means of support bars 76 attached to crossbars 77 mounted to plates 78 by means of suitable weldments. Adjustment screws 80 are provided to vary the vertical positioning of skate assembly 64 which has a base plate 82 pivotally secured to upright bar 76 by means of bearing pins 84.

Figure 7:
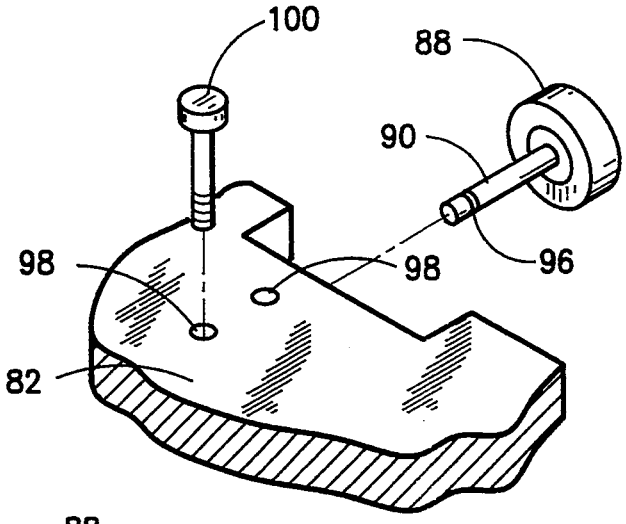
FIG. 7 is a perspective view, partially broken-away, showing the construction of a skate roller used with the skate assembly shown in FIGS. 5 and 6.
Figure 6:
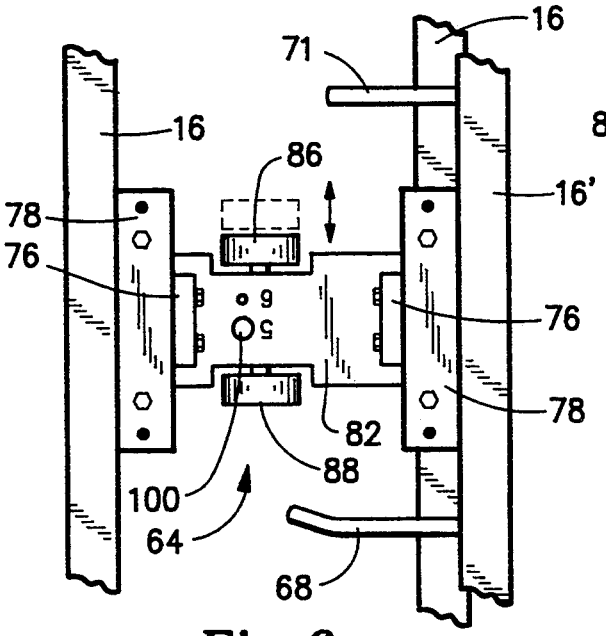
FIG. 6 is a top plan view of the first skate assembly and an upstream end portion of the first and second guide bars shown in FIG. 5.
Figure 8:
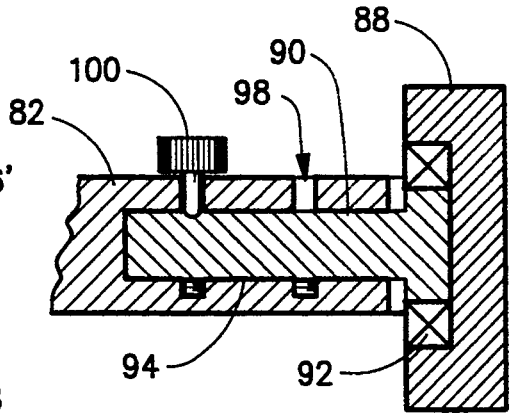
FIG. 8 is a cross-sectional view showing the assembled skate roller of FIG. 7.

Base plate 82 rotatably supports skate rollers 86 and 88 which are respectively journaled on axles, such as axle 90 shown in FIGS. 7 and 8. Thus, for example, roller 88 is mounted to axle 90 by means of a bearing 92, and axle 90 is matably received in a transverse bore 94 extending into base plate 82. Roller 88 may be adjustably positioned between two locations (designated "5" and "6") so that differently sized gutters may be formed by forming apparatus 10. Thus, as is shown in FIGS. 6–8, axle 90 has a circumferential groove 96 located proximately to the free end of axle 90 which is opposite roller 88. Base plate 82 has vertical bores 98 which intersect transverse bore 94 approximately tangentially thereto with bore 98 being sized to receive a retaining pin 100. Pin 100 is threaded into bore 98 to lock roller 88 in a first position shown in FIGS. 6 and 8 or a second position shown in phantom in FIG. 6.

Figure 9:
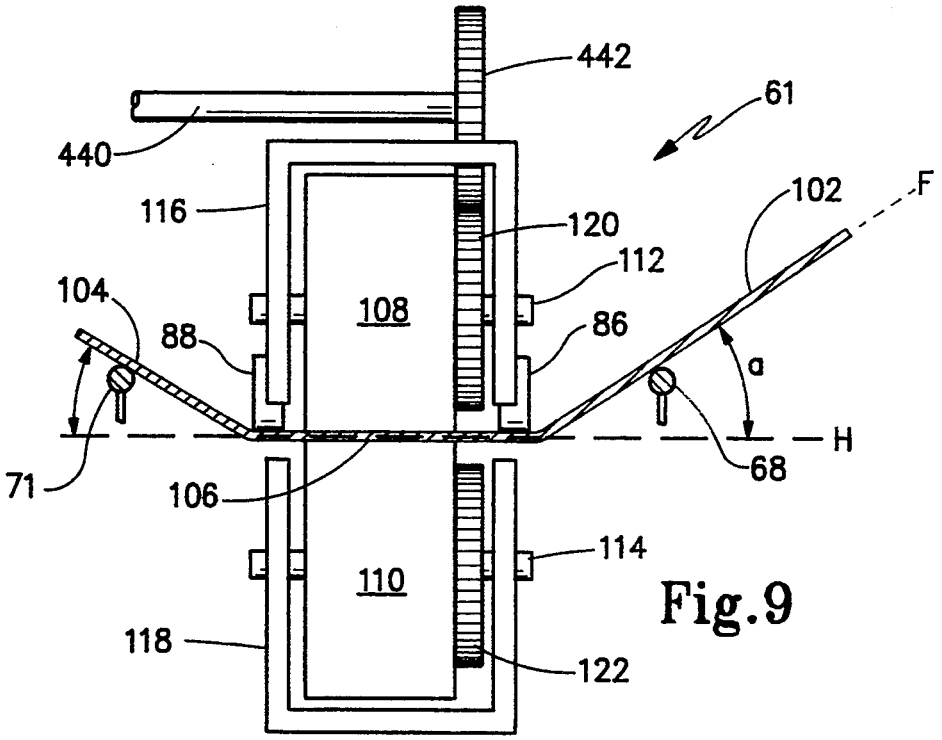
FIG. 9 is an end view in elevation and in partial cross-section showing a representative drive roller assembly according to the exemplary embodiment of the present invention.
Figure 4:
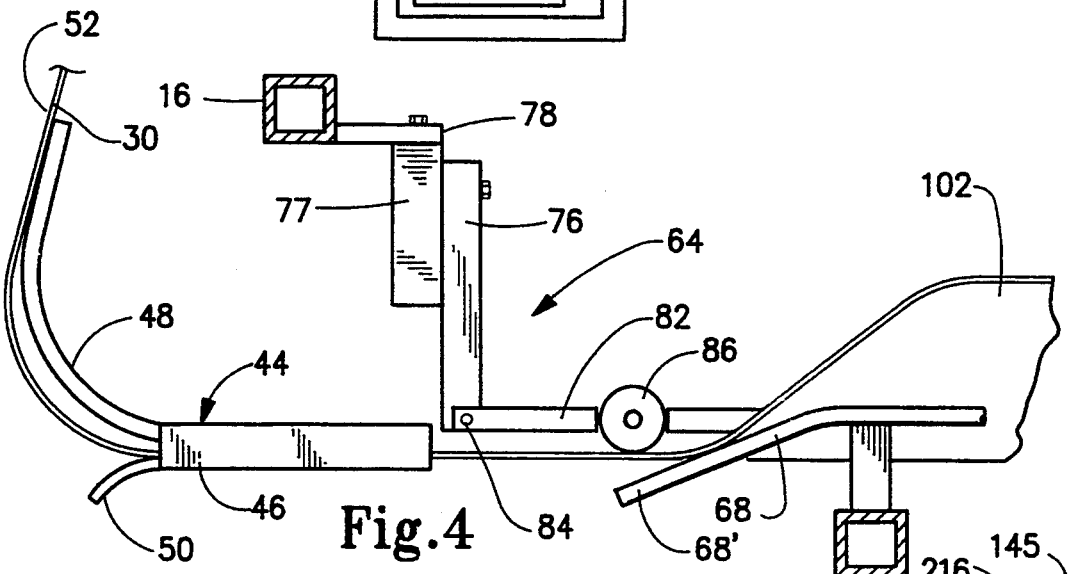
FIG. 4 is a side view in elevation of the entry guides, first skate assembly and first guide bar shown in FIGS. 1–3.

With reference to FIGS. 2, 4 and 9, it may be seen that, when sheet 30 is inserted into entryway 26 through guide channels 46, rollers 86, 88 of skate assembly 64 rests on an upper surface thereof. Guide bars 68 and 70 (as represented by guide bar section 71) have upstreamed ramp portions 68′ and 71′, respectively, which cause the longitudinal margins 102 and 104 of sheet 30 to be deflected upwardly thereby bending sheet 30 into a trough-shaped cross-section, as best shown in FIGS. 2 and 4. First roller assembly 61 may then engage a central portion 106 of sheet 30 so that sheet 30 may be advanced longitudinally from upstream elongated 26 to downstream exit 28. Marginal portion 102 defines a first forming plane "F" oriented as an angle "a" with respect to horizontal plane "H" defined by central portion 106.

In FIG. 9, it may be seen that roller assembly 61 includes first or upper drive roller 108 and a second drive roller or lower roller 110 that co-act with one another to grip central portion 106 therebetween. Drive rollers 108, 110 counter-rotate with respect to one another on axles 112, 114, respectively which are journaled in U-shaped brackets 116, 118, respectively. Rollers 108, 110 are provided with gears 120, 122 which form part of drive assembly 60 described more thoroughly below.

Figure 10A:
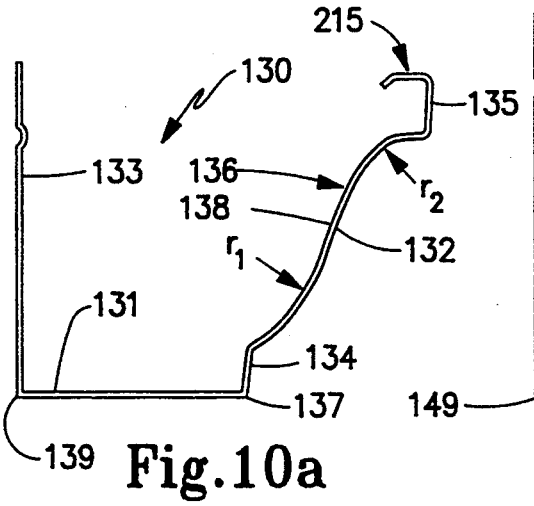
FIGS. 10(*a*) and 10(*b*) are cross-sectional views showing a representative formed structure (depicted as a gutter) in two different sizes having a geometrically similar configuration and as formed by the exemplary embodiment of the present invention.
Figure 10B:
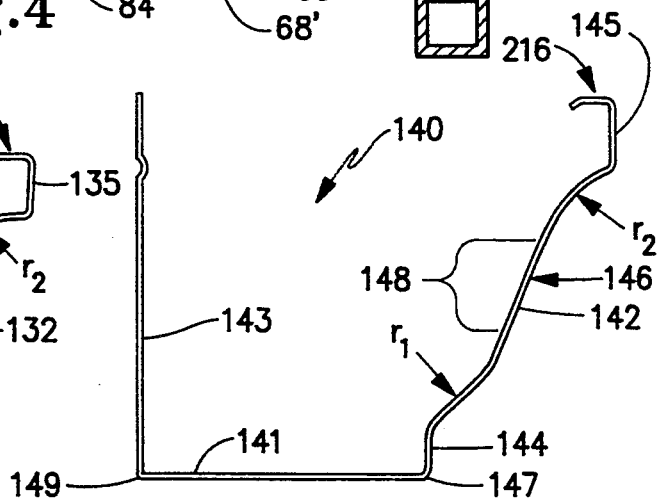

As noted above, forming apparatus 10 as constructed in the exemplary embodiment of the present invention is operative to form gutters as the shaped members produced from sheet 30. An important aspect of the present invention, in addition to the "troughing" of sheet 30 prior to introduction into the forming stations is the ability of forming apparatus 10 to produce at least two similar cross-sections of shaped members which are geometrically similar by differently dimensioned. For example only, as is shown in FIGS. 10(*a*) and 10(*b*), gutter sections 130 and 140 are shown. Gutter 130 is a five inch ogee-type gutter while gutter 140 is a six inch ogee-type gutter. Thus, in FIG. 10(*a*), gutter 130 is in the form of a channel shaped member having a bottom wall 131, a shaped sidewall 132 and a relatively perpendicular sidewall 133 opposite shaped wall 132. Shaped 132 has a lower margin 134 and an upper margin 135 separated by S-shaped central portion 136. S-shaped central portion 136 is formed as two curved sections formed at radii as "$r_1$ and $r_2$", respectively separated by a small, relatively linear central section 138. In the standard five inch gutter, bottom wall 131 is approximately $3\frac{1}{4}''$ in width, shaped wall 132 is approximately $3\frac{1}{2}''$ in height, and sidewall 133 is approximately $3\frac{3}{4}''$ in height. Furthermore, margin 134 is approximately 9/16″ in height while margin 135 is approximately $\frac{5}{8}''$ in height.

With reference FIG. 10(*b*), it may be seen that geometrically similar gutter 140 includes a bottom wall 141, a shaped sidewall 142 and a perpendicular sidewall 143. Shaped sidewall 142 has a lower margin 144 formed at right angles to bottom wall 141 and an upper margin 145 separated from lower margin 144 by means of S-shaped central portion 146. In FIG. 10(*b*), which represents a six inch ogee-type gutter, bottom wall 141 is approximately $3\frac{7}{8}''$ wide, shaped wall 142 is approximately $4\frac{1}{2}''$ high and sidewall 143 is approximately $4\frac{3}{4}''$ in height. Margin 144 is approximately 9/16″ in height while margin 145 is approximately $\frac{7}{8}''$ in height. The double curves are again formed at radii "$r_1$" and "$r_2$" and are separated by a linear central section 148 that is provided to allow for the additional height of shaped wall 142.

As noted above, guide bar 68 is operative to deflect or bend elongated sheet 30 so that first margin portion 102 is oriented in a forming plane that is at a first angle with respect to central portion 106 the elongated sheet 30 engaged by drive assembly 61. Thus, first margin 102 is positioned in a forming plane that is at an angle with respect to the horizontal plane containing central portion 106. Preferably, this angle is approximately 40° although forming plane angles of between 20° and 60° inclusive are believed quite suitable in use. By "pre-bending" sheet 30 without the use of forming rollers, it is possible to reduce the longitudinal length of forming apparatus 10 to make forming apparatus 10 less bulky and to allow it to fit, for example, on the bed of a standard pickup truck. Because of this pre-bending, though, it is necessary that the first group of forming rollers be journaled on axes which are parallel to this forming plane so that the forming channel formed therebetween is generally in the forming plane.

Figure 11:
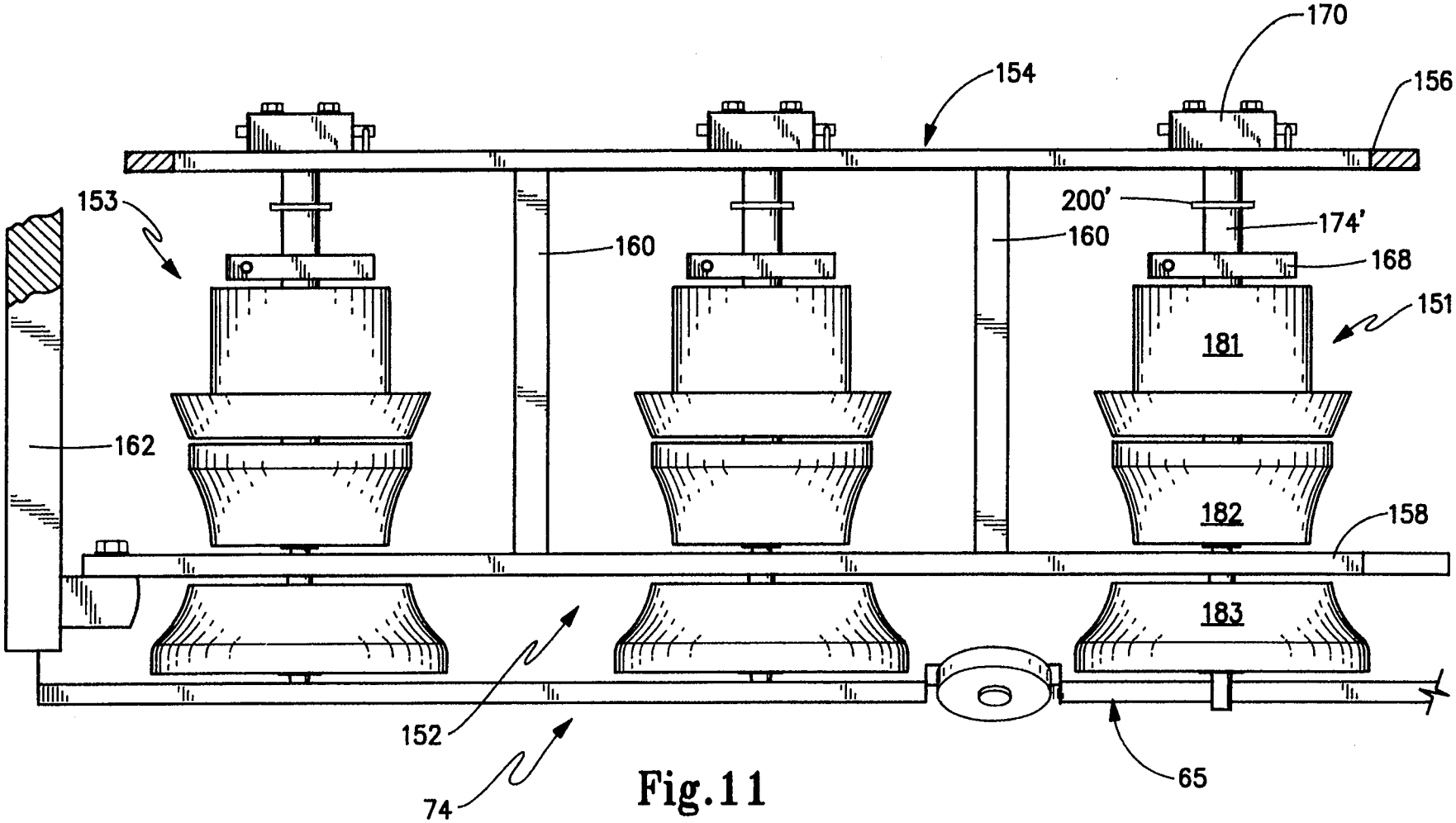
FIG. 11 is a side view in elevation showing three forming stations organized as a first assemblage of forming rollers according to the exemplary embodiment of the present invention.
Figure 12A:
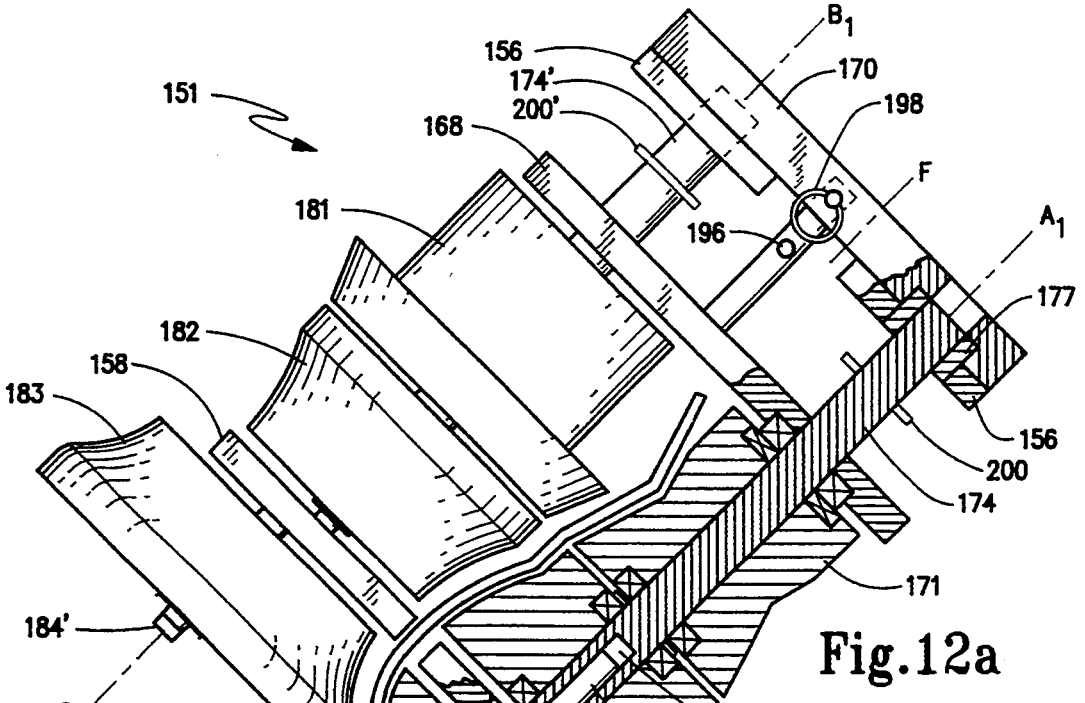
FIGS. 12(*a*) and 12(*b*) are end views in elevation and in partial cross-section showing the first forming station of FIG. 11 with FIG. 12(*a*) being in a collapsed configuration for producing the formed profile of FIG. 10(*a*) and with FIG. 12(*b*) showing the expanded configuration for producing the formed profile of FIG. 10(*b*)
Figure 12B:
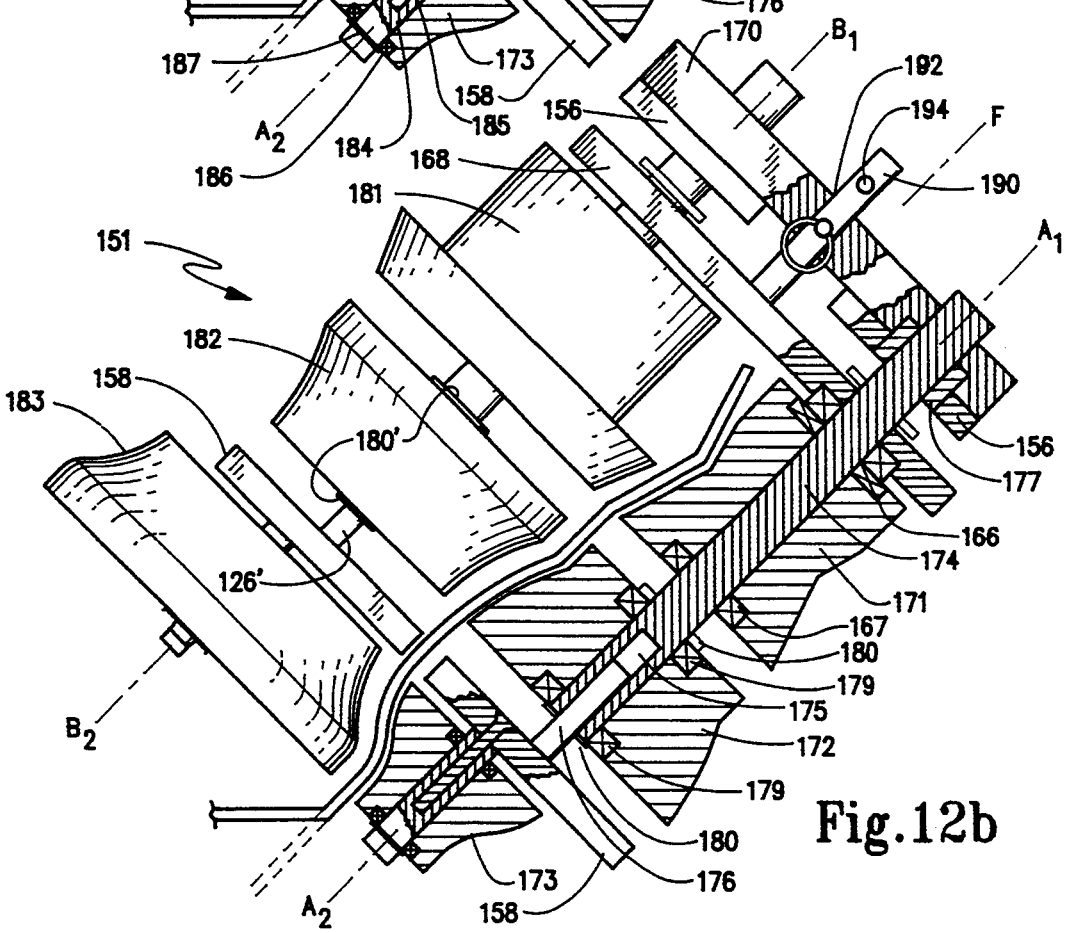

A representative first group of forming stations in the form of assemblage or forming box 74 is therefore shown in FIGS. 11–12. Forming box 74 comprises three forming stations 151, 152 and 153 which are supported on a common sub-frame which is in turn mounted to frame 12. As is shown in FIG. 11, sub-frame 154 includes longitudinal bars 156 and 158 which are connected together by connecting rods 160 and to frame 12 in any suitable manner, such as downwardly depending bars 162. Each forming station includes at least one pair of first and second forming rollers journaled for rotation about first and second axes respectively, with the first and second forming rollers being disposed on opposite sides of the first forming plane and configured to deform the first margin into a selected profile. Accordingly, a description of first forming station 151 is provided with respect to FIGS. 11 and 12, although it should be appreciated that forming stations 152 and 153 are constructed similarly.

In FIGS. 11 and 12, it may be seen that first forming station 151 includes three pairs of first and second rollers in the form of three first rollers 171, 172 and 173 and three second rollers 181, 182 and 183. Rollers 171, 181 co-act with one another as do rollers 172, 182 and 173, 183. Rollers 171 and 172 are journaled for rotation on a axis "$A_1$" being defined by axle 174 which extends through axle passageway in rollers 171 and 172. Axis "$A_1$" is generally parallel to forming plane "F". Axle 174 includes an axle bore 175 that is sized to matably receive axle pin 176 that is secured in perpendicular relation to one of longitudinal bars 158. Axle 174 is axially slideable with respect to axle pin 176 by way of a bushing 177 mounted in passageway 178 formed through longitudinal bar 158 and rigid crosspiece 170. Roller 171 is secured to movable positioning arm or crosspiece 168 by means of a bearing 166, and movable crosspiece 168 is movably mounted by means of upright post 190 received through bore 192 located centrally in rigid crosspiece 170. Roller 172 is rotatably journaled on axle 174 by means of bearings 179 and is held in position by means of clips 180. Roller 173 is rotatably journaled to an axle 184 mounted to longitudinal bar 158 by means of axle pin 185 and is rotatably journaled by means of bearing 186. A clip 187, holds roller 173 on axle 185.

As noted, the mounting of rollers 181–183 is the same as that described with respect to rollers 171–173 so that operation of the three pairs of co-acting rollers and the adjustment thereof may now be more fully appreciated. Here, rollers 181 and 182 are journaled on axle 174' oriented along axis "$B_1$~; roller 183 is journaled on axle 184' oriented along axis "$B_2$". Axes $A_1$, $A_2$, $B_1$ and $B_2$ define a roller plane that is oriented perpendicularly to the forming plane "F". Furthermore, each of these axes are parallel to the forming plane "F". Movable crosspiece 168 thus provides mechanical linkage interconnecting adjustable rollers 171, 181 and 172, 182.

With reference again to FIGS. 12(*a*) and 12(*b*), it may be seen that upright rod 190 has a pair of diametric openings 194, 196 which may be respectfully used to switch forming station 151 between a five inch and a six inch sizing for gutters 130, 140, respectively. In FIG. 12(*a*) a retaining pin 198 extends through rigid crosspiece 170 to be received in diametric hole 194, and rollers 171–173 are relatively collapsed in spacing with respect to one another in the direction of axes $A_1$ and $A_2$. Rollers 181–183 are likewise relatively collapsed in spacing with respect to one another along parallel axes $B_1$ and $B_2$. In FIG. 12(*b*), rollers 171–173 and 181–183 are relatively expanded in spacing, and this is accomplished by removing retaining pin 198 from diametric opening 194 and moving movable crosspiece 168 toward rigid crosspiece 170 and resecuring upright rod 190 by inserting pin 198 into diametric opening 196. As may be seen in FIGS. 12(*b*), when crosspiece 168 begins to move toward crosspiece 170, co-acting rollers 171, 181 are moved away from rollers 172, 182, respectively. At such time that movable crosspiece 168 contacts retaining rings 200 and 200' which provide limit stops such that axles 174, 174' are forced to move correspondingly with movable crosspiece 168. Axles 174, 174' thus slide off of axle pins 176 and 176' and through the respective bushings, such as bushing 177 so that rollers 172, 182 move away from longitudinal bars 158 and, correspondingly, rollers 173, 183. This is because rollers 172, 182 are locked onto their respective axles by means of retaining clips, such as clips 180 and 180'.

Naturally, the collapse of the spacing between rollers 171–173 and rollers 181–183 is accomplished by reversing this procedure. With reference again to FIGS. 10(*a*) and 10(*b*), it may be seen that the expanded spacing of forming station 151 increases the dimensioning necessary for shaped sidewall 142 over the dimensioning of shaped sidewall 132.

The construction of forming stations 152 and 153, insofar as the rotatably journaling of the respective first and second co-acting pairs of rollers is concerned, is identical to that described with respect to forming station 151. It should be noted, however, that the circumferential working surfaces of the respective rollers are configured as necessary to shape the profile of the shaped member, such as the ogee-type gutter. Configuration of these rollers for a selected profile is as understood in the art.

As noted with respect to FIGS. 10(*a*) and 10(*b*), it is also necessary to increase the width of bottom wall 141 over the width of bottom wall 131. This is accomplished by adjusting the skate roller 88 described above with respect to FIGS. 5–8. Thus, the throw of axle 90 in bore 94 should be approximately $\frac{5}{8}$' since the deflection of second margin 104 by guide bar 171 forms the corner 139, 149. Likewise, the deflection of first margin 102 against skate roller 86 forms corners 137, 147, all as is best shown in FIG. 9.

Figure 13:
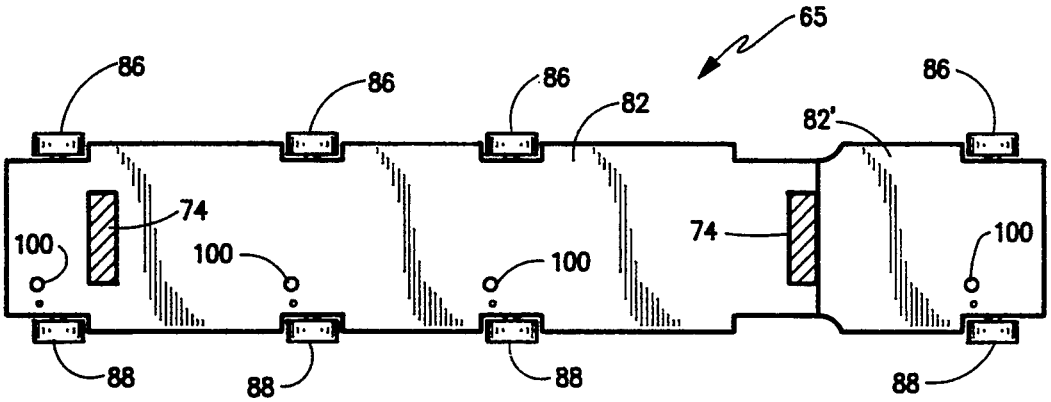
FIG. 13 is a top plan view showing the second skate assembly of FIG. 3.
Figure 14:
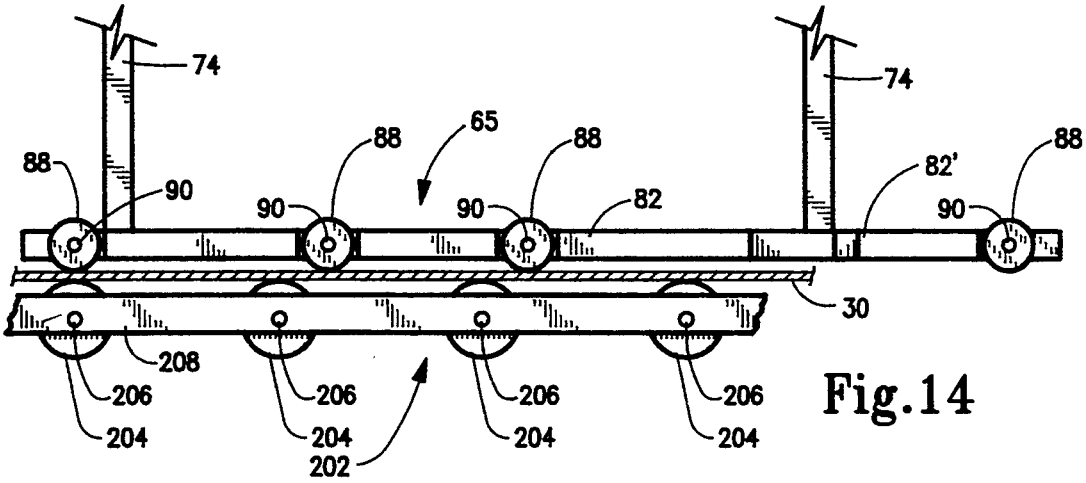
FIG. 14 is a side view in elevation of the skate assembly of FIG. 13 along with the cooperating platen assembly.

With reference again to FIGS. 3 and 11, it may be seen that a second skate assembly 65 underlies forming box 74 and is constructed similarly to first skate assembly 64. A third skate assembly 66 is likewise similar in construction to skate assemblies 64 and 65 and may be seen in greater detail in FIGS. 13–15. Here, third skate assembly 65 includes longitudinal base plates 82, 82' which are supported by downwardly support bars 74.

Figure 15:
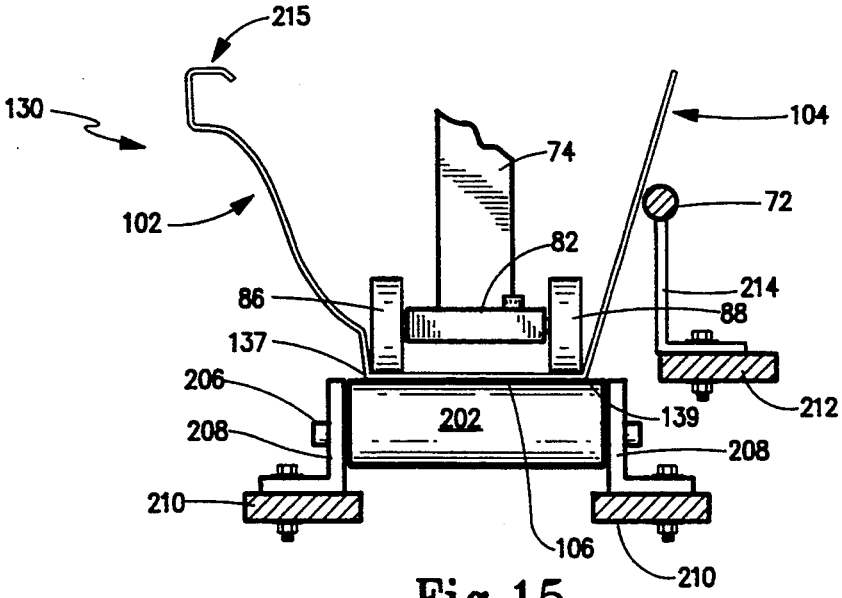
FIG. 15 is an end view in elevation and in partial cross-section of the skate assembly and platen assembly of FIG. 14.

Base plates 82, 82' rotatably mount a plurality of pairs of laterally projecting skate rollers 86, 88 constructed identically to those described with respect to skate assembly 64. Each of skate rollers 88 is again adjustable by means of their respective axles 90 and retaining pins 100. However, as can be seen with reference to FIGS. 14 and 15, a platen roller assembly 202 underlies the third skate assembly 65. Platen roller assembly 202 includes a plurality of platen rollers 204 rotatably journaled on axles 206 between a pair of keel rails 208 that are mounted on longitudinal supports 210. Platen rollers 202 cooperate with rollers 86, 88 to form, for example, corners 137 (or 147) and 139 (or 149) of gutter 130 (or 140). Guide bar section 72 is supported on longitudinal support 212 by means of L-shaped bracket 214 so that guide bar 70, as defined by sections 71 and 72 converges toward the drive assembly at an acute angle from entryway 26 towards exit 28. Thus, second margin 104 is gradually moved at an increasingly larger angle until it reaches a perpendicular orientation with respect to central portion 106, as is shown in FIG. 15. Similar platen roller assemblies may be used under skate assemblies 64 and 65 although it is preferable to omit a platen roller assembly under skate assembly 64 to allow easier "troughing" of sheet 30.

Figure 17:
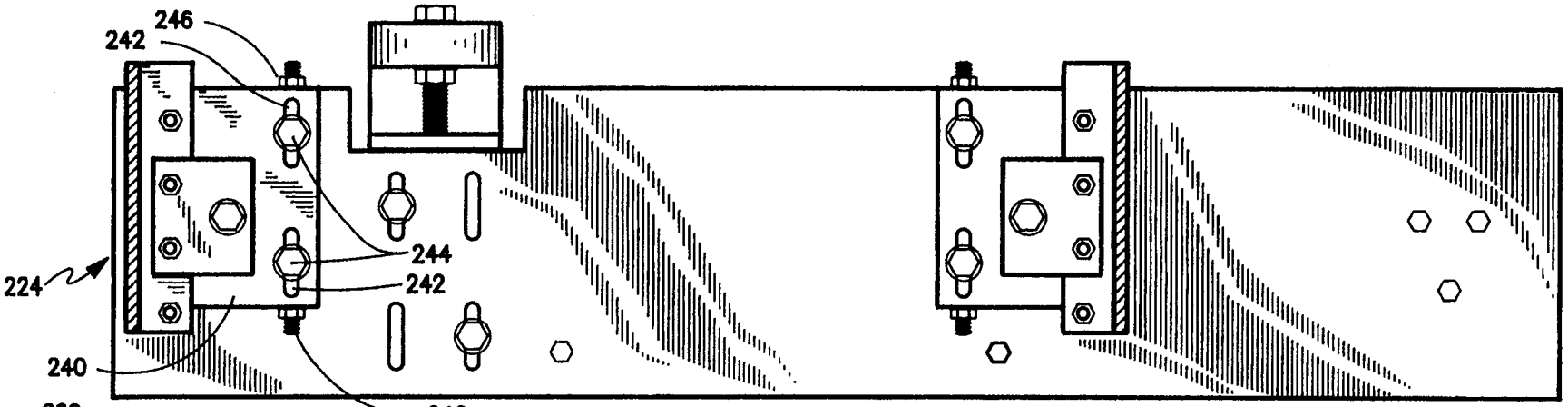
FIG. 17 is a top plan view of the second group of forming stations shown in FIG. 16.
Figure 16:
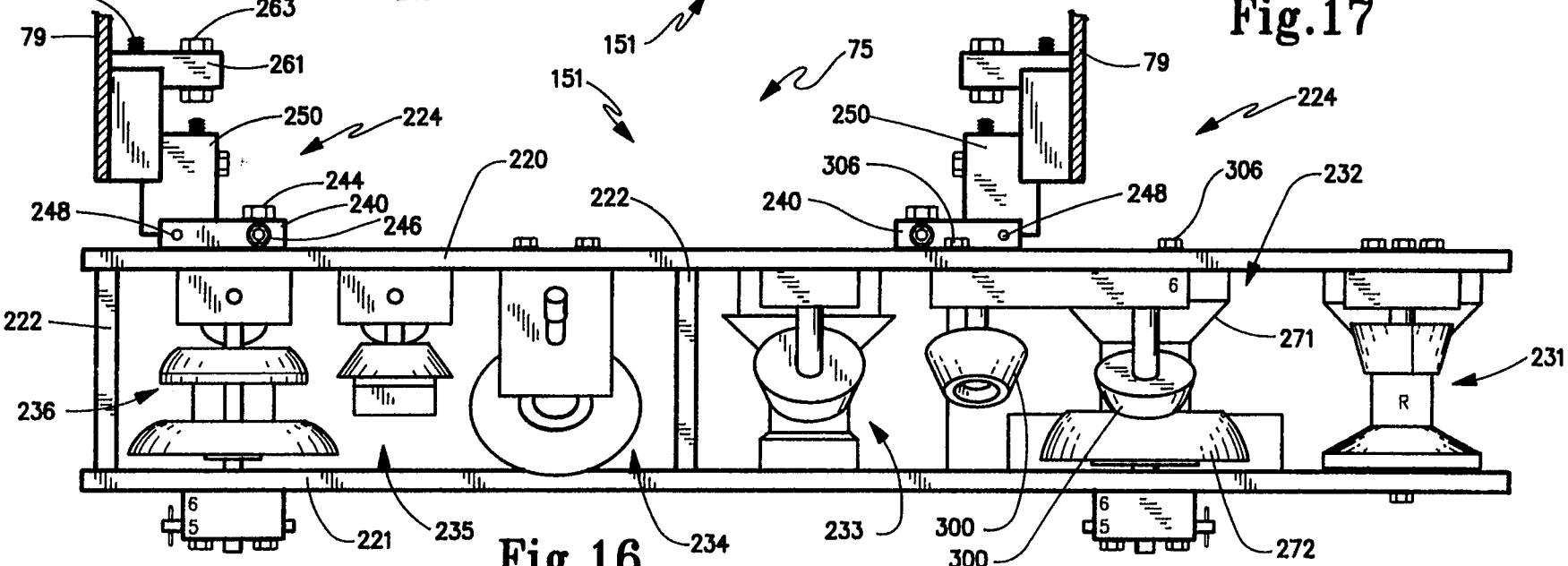
FIG. 16 is a side view in elevation showing additional forming stations organized in a second assemblage for creating the profile shown in FIGS. 10(*a*) and 10(*b*)
Figure 18B:
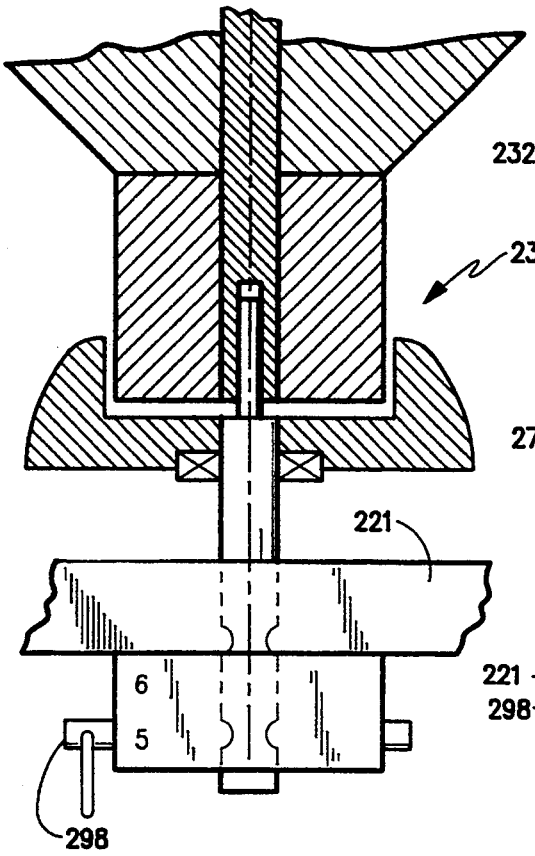
FIGS. 18(*a*) and 18(*b*) are side views in partial cross-section showing a pair of forming rollers of FIG. 16 in a contracted and expanded condition, respectively.
Figure 18A:
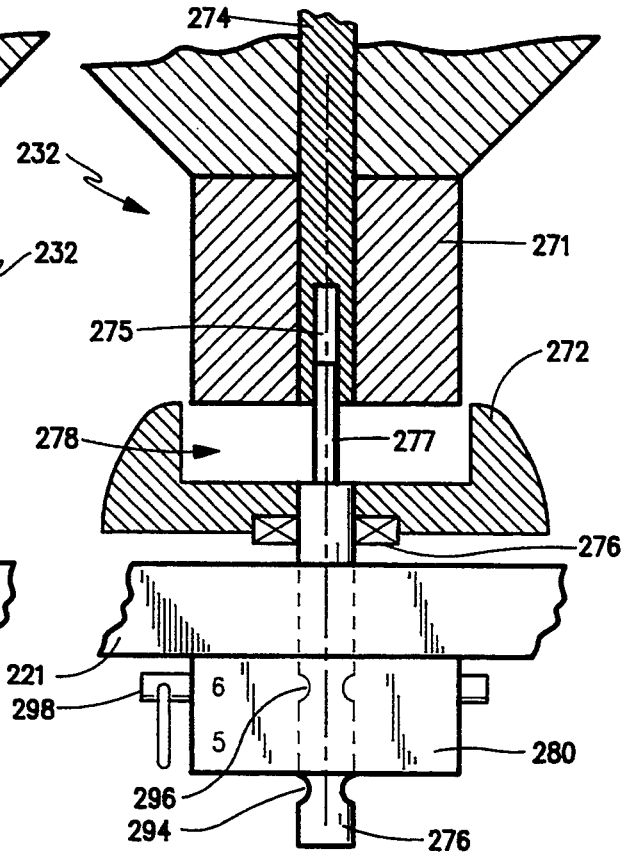

A second assemblage or forming box 75 forms the head 215 (or 216) of gutter 130 (or 140). This forming box 75 is best shown in FIGS. 16 and 17. Here, it may be seen that forming box 75 includes a sub-frame 151 formed by pair of parallel support plates 220, 221 which are spaced apart and connected to one another by means of connecting rods 222. A plurality of forming stations 231–236 are disposed between support plates 220 and 221 and are mounted thereto for rotation. Sub-frame 151, and thus forming box 75 is mounted to framework 12 by means of adjustable mounts 224 secured to brackets, such as brackets 79. The particular construction of the first and second forming rollers for each of forming stations 231–236 are again within the scope of the ordinarily skilled person in this field based on the type of profile desired to be formed and so are not described in detail. However, with respect to changing dimension between gutters 130 and 140, it is necessary to provide some adjustment for these, co-acting rollers especially as it relates to the dimensioning of head portions 215, 216 and margins 135, 145. To this end, with reference to FIGS. 18(*a*) and 18(*b*), it may be seen that adjustment may be made in the spacing by means of a pair of first rollers 271, 272 that provide the first forming rollers of forming station 232. Rollers 271, 272 are relatively movable in an axle direction to change the relative spacing therebetween. As can be seen in FIG. 18(*a*), roller 271 is rotatably journaled on axle 274 while roller 272 is rotatably journaled on an axle 276. Axle 276 is provided with diametric holes 294, 296 located at one thereof which is slideably received in adjusting block 280. An axially aligned axle pin 277 projects into axial bore 275 formed in axle 274, and an enlarged cavity 278 is formed in roller 272 and faces the roller 271. In comparing FIGS. 18(*a*) and 18(*b*), it may be seen that, in the expanded relative state shown in FIG. 18(*a*), pin 277 is only partially received in axial bore 275 and only a small portion of roller 271 is received in cavity 278. This relative orientation can be moved into a collapsed configuration, shown in FIG. 18(*b*), by removing pin 298 from adjustment block 280 and advancing axle 276 upwardly so that pin 298 may be advanced into diametric opening 294. When so moved, roller 272 moves upwardly so that roller 271 is received in cavity 278 and axle pin 277 is received in axially bore 275.

Figure 19:
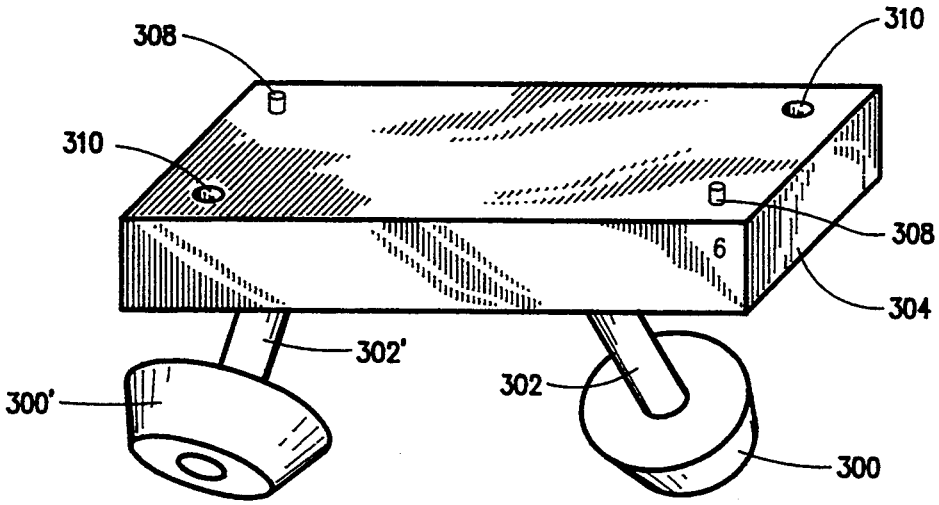
FIG. 19 is a perspective view of a second pair of forming rollers used in producing the profiles of FIGS. 10(*a*) and 10(*b*) and showing alternative second forming rollers for engaging the first forming rollers.

An additional adjustment is necessary since, at this stage, alternative ones of side rollers 300, 300' must be selectively placed into position. As is shown in FIGS. 16 and 19, rollers 300 and 300' are oriented at canted axles 302, 302' to roller block 304 which is mounted by means of bolts 306 to horizontal support 220. With reference to FIG. 19, it may be seen that block 304 includes alignment pins 308 and threaded openings 310 with threaded openings 310 being sized to receive bolts 306. To change side rollers 300, 300' to alternatively co-act with first rollers 271, it is necessary to remove bolts 306 and rotate block 304 about a vertical axis a full 180° and then to remount 304 to longitudinal horizontal support 220. The reason for this is that the relatively thin thickness of each roller does not permit telescopic construction. Naturally, if physical dimensions were sufficient, the second roller could be adjustably sized in a manner described with reference to the other adjustable rollers noted above.

Figure 20:
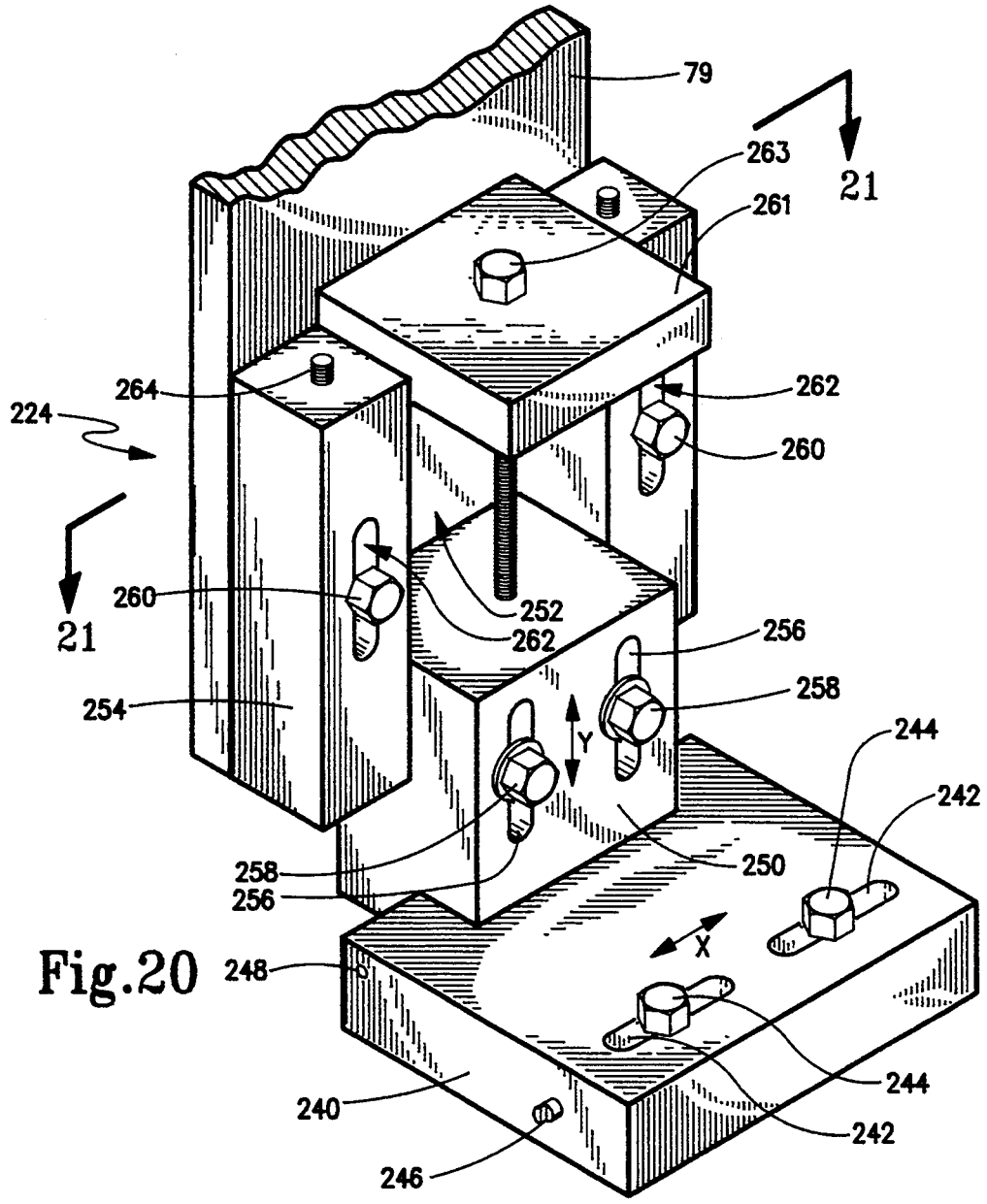
FIG. 20 is a perspective view of an adjustable mount shown in FIGS. 16 and 17.
Figure 21:
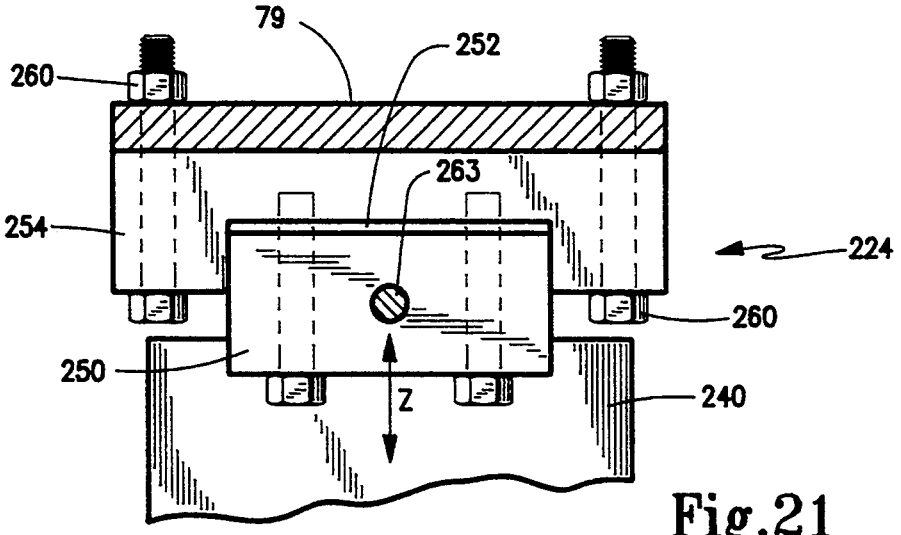
FIG. 21 is a top plan view of the gimble mount of FIG. 20.

The construction of adjustable mounts 224 are best shown with reference to FIGS. 20 and 21. Here, it may be seen that adjustable mount 224 are constructed to permit adjustment in an "x" axis and a "y" axis that are transverse to the downstream direction whereby the yaw and pitch of the sub-frame 151 may be selectively varied. Furthermore, adjustable mounts 224 are constructed to allow rotational adjustment about a "z" axis that is perpendicular to the "x" and "y" axis noted above. With reference, then, to FIGS. 20 and 21, it may be seen that adjustable mounts 224 include a base plate 240 that includes slots 242 adapted to receive bolts 244. Jack screws 246 permit side-to-side adjustment, in the "x" direction. Base plate 240 is pivotally secured to connecting block 250 by means of a pivot pin 248. Connecting block 250 is slidably received in a channel 252 formed in channel block 254. Connecting block 250 has a pair of slots 256 adapted to receive mounting bolts 258 so that connecting block 250 may be slidably adjusted, in the direction of the "y" axis by loosening and tightening bolts 258. Finally, channel block 254 is mounted to support 79 by means of a plurality of nut and bolt sets 260 received through slots 262 formed therein. Jack screws 264 are provided to adjustably position bolts 260 and, it should be appreciated that slots 260 are sufficiently "sloppy" to allow rotational adjustment over a small range about a longitudinal axis perpendicular to channel block 254. Thus, the "roll" of the sub-frame 151 may be adjusted. Block 261 is bolted rigidly to channel block 254 and threadably mounts an adjusting bolt 263 which operates to move connecting block 250 in channel 252.

Figure 22:
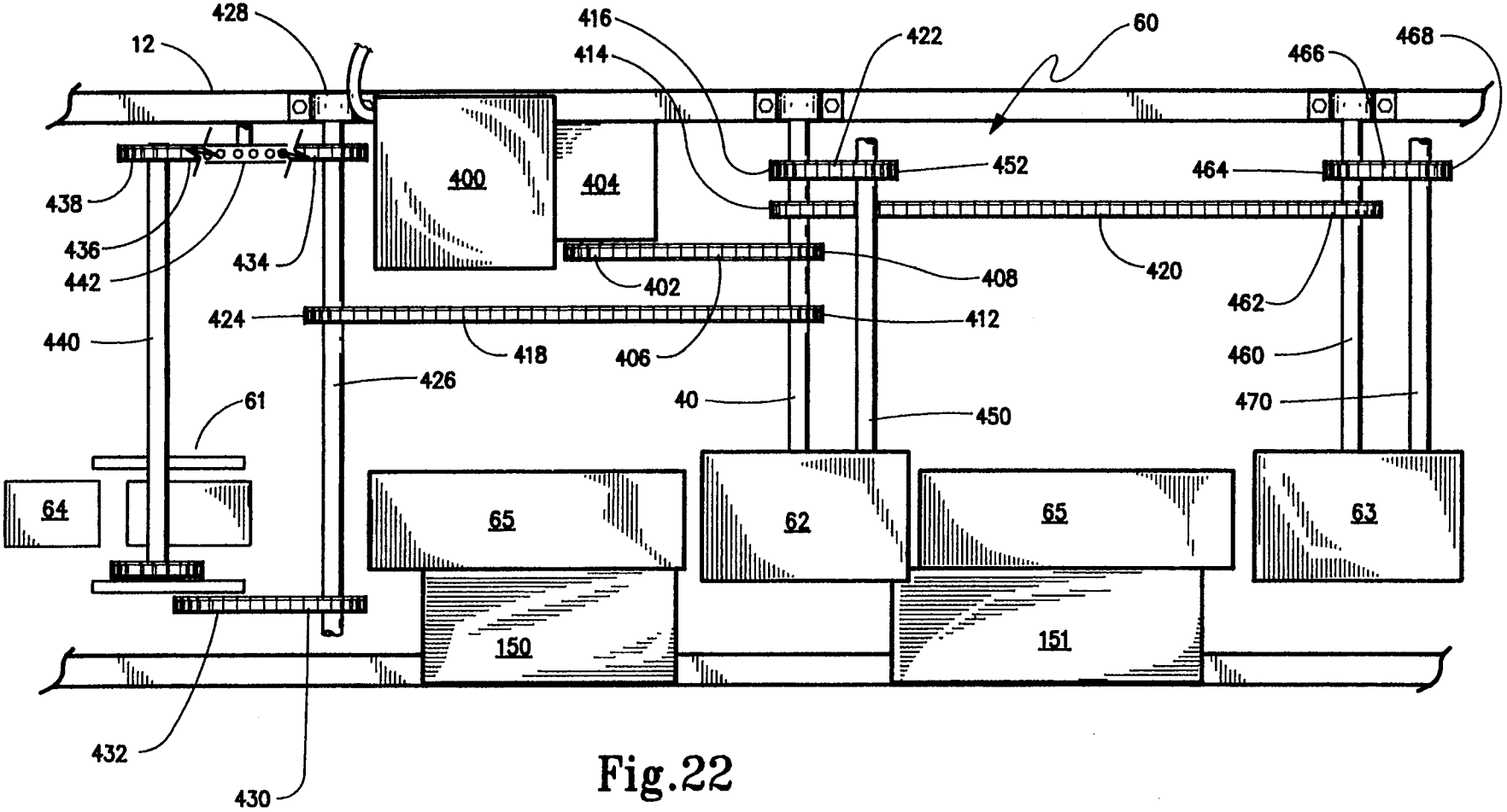
FIG. 22 is a top plan view showing a representative drive assembly used in the exemplary embodiment of the present invention.

With reference again to FIGS. 3 and 22, it may be appreciated that a suitable chain and gear drive may be implemented with respect to roller assembly 61, 62 and 63. In FIG. 22, it may be seen that a motor 400 is connected to a drive gear 402 by means of gear box 404. Drive gear 402 drives a primary drive chain 406 that turns gear 408 on drive axle 410. Drive axle 410 is provided with gears 412, 414 and 416 which respectively engage chains 418, 420 and 422. Drive chain 418 drives gear 424 located on axle 426, with axle 426 rotatably journaled with respect to frame 12 by means of pillow blocks 428. Axle 426 has a first gear 430 which engages a gear 432 that is operative to drive gear 122 and lower roller 110 (best seen in FIG. 9). A second gear 434 is mounted on axle 426 and drives a chain 436 connected to upper gear 438 on axle 440. Tension sprocket 442 is used to adjust the tension of chain 436 in order to rotatably drive axle 440 which drives a gear 442 that is operative to engage gear 120 and thus rotate roller 108 as is again seen in FIG. 9.

Returning to axle 410, it may be seen that it drives a lower roller of second roller assembly 62 and an upper axle 450 is driven by means of gear 452 drive by chain 422. Axle 450 rotatably drives the upper roller in roller assembly 62. Chain 420 drives a gear 462 on axle 460 which in turn drives a lower roller in roller assembly 63. Axle 460 carries a roller 464 that drives a chain 466 in order to rotate gear 468 on upper axle 470. Axle 470 rotates the upper roller in roller assembly 63.

Since the description of roller assembly 61 has been described in some detail, it should be apparent to the ordinarily skilled person in this field that the structure of roller assemblies 62 and 63 are comparable. Furthermore, it is to be understood that other drive assemblies may be incorporated to advance sheet 30 from the upstream end to the downstream end of forming apparatus 10 without departing from the scope of this inventive or this inventive concepts described in this disclosure.

Figure 23:
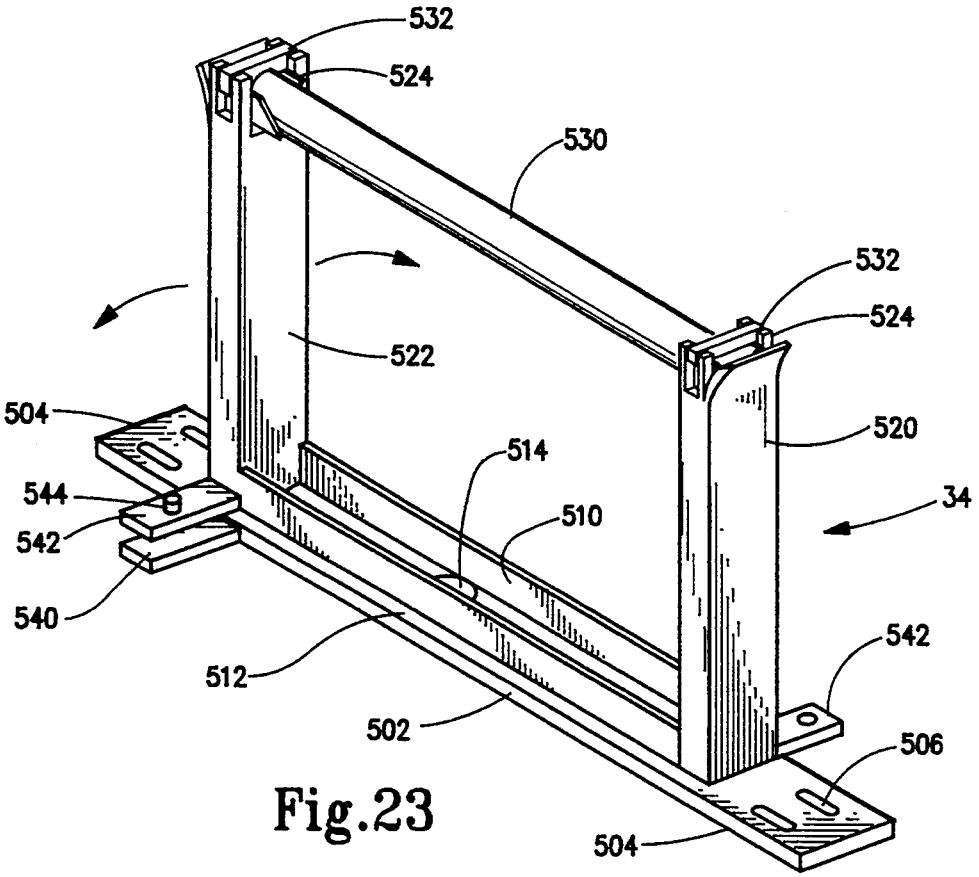
FIG. 23 is a perspective view of a reel mount assembly shown in FIG. 1.
Figure 24:
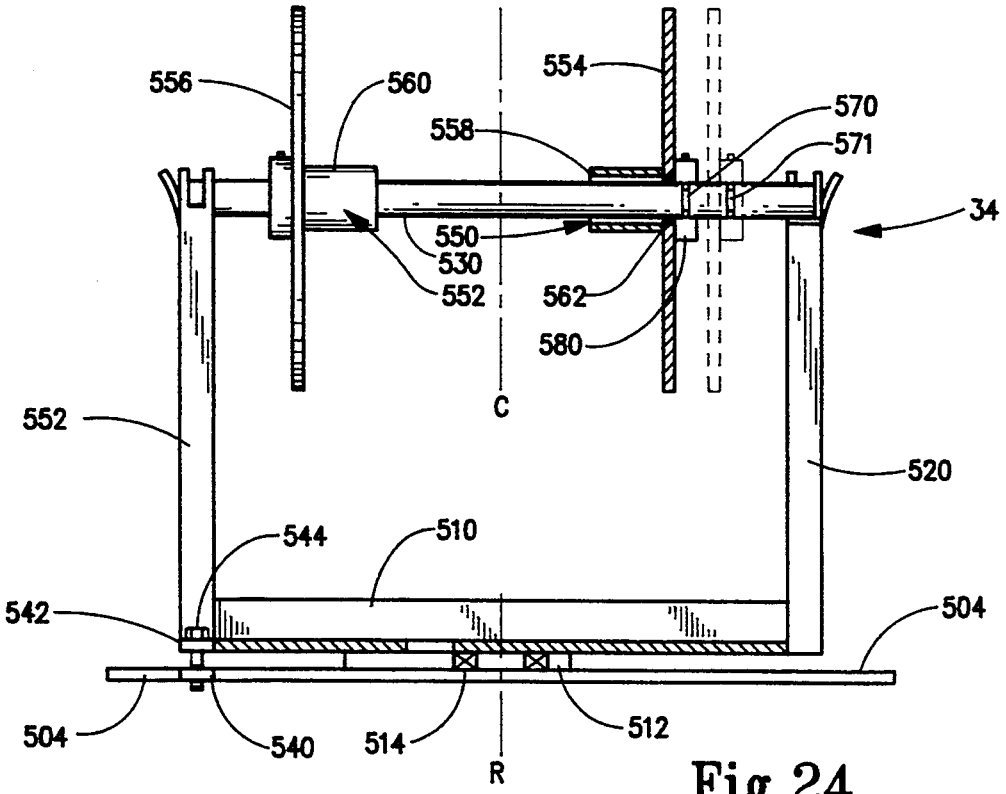
FIG. 24 is an end view in elevation and in partial cross-section showing the reel assembly of FIG. 23.

Finally, as noted above, it is contemplated that sheet 30 may be provided from a continuous coil of material. Accordingly, with references to FIGS. 1 and 23–24, it may be seen that a representative reel assembly 34 is provided to support a coil, such as coil 32 shown in FIG. 1. Each of reel assemblies 34, 38 and 42 are identical in construction, which construction is best shown in FIGS. 23 and 24. However, it should also be appreciated that, in order to cut the shaped members into desired lengths, it is necessary that a shear assembly, such as shear assembly 500, be located at the downstream or exit 28 of forming apparatus 10. Again, a variety of shear assemblies for gutters, roof panels, etc., are known in the art and may be incorporated into the present apparatus without departing from the inventive concepts described herein.

Turning, then, to FIGS. 23 and 24, it may be seen that reel assembly 34 includes a transverse mounting plate 502 having oppositely disposed wings 504 including slots 506 for mounting onto framework 12. A channel member 510 is rotatably mounted to transverse member 504 by means of bearing plate 512 and bearing 514 so that channel member 510 may relatively rotate about axis "R" shown in FIG. 24. Opposite ends of channel member 510 are provided with first and second uprights 520, 522 which extend upwardly to terminate in V-shaped supports 524. Reel axle 530 extends between V-shaped supports 524, and latch assemblies 532 releasably retain axle 530 in the mounted configuration. Transverse support 502 includes a longitudinal ear 540, and each of upright supports 522 has an associated longitudinal ear 542 positioned to register with longitudinal ear 540 as channel member 510 rotates about axis "R". A retaining pin 544 may releasably secure channel member 510 at a selected position of rotation, 180° apart from one another.

Each coil of material may be rotatably mounted on axle 530 by means of spool halves 550 and 552. Each spool half includes a disk-shaped plate, such as plate 554 and 556 and coil inserts 558, 560. Coil inserts 558, 560 are opposed to one another and are adapted to be inserted into their respective coil such as coils 32, 36 and 40. Spool halves 554, 556 are rotatably journaled on axle 530, for example, by bearing 562. In order to accommodate coils of different widths so that differently dimensioned cross-sections may be fabricated, each of spool halves 550 and 552 are slidable on axle 530. First and second detent grooves 570, 571 are provided to set the position of spool half 550, as shown in phantom in FIG. 24, and a detent structure 580 engages the selected groove 570, 571 in order to set this width position. Detent grooves 570, 571 are provided so that the center "C" of each coil is aligned with rotational axis "R". Where the gutters 130, 140 of FIGS. 10(*a*) and 10(*b*) are to be fabricated, for example, the width of the respective coils are $11\frac{7}{8}''$ and $15''$.

In use, it may seen that a coil may be positioned on reel assembly 34 by placing spool half 550 at the correct location engaged by detent assembly 580 and then sliding spool half 552 to engage in opposite end of the coil. Sheet 30 is then fed off of the coil and into entryway 26 for fabrication. Sheet 30 may have opposite surfaces painted different colors, and it should be appreciated with reference to FIGS. 2 and 10 that the undersurface provides the exterior appearance of the gutter 130, 140. In order to change the color, the fabricator releases pin 544 and rotates reel assembly 34 180° about axis "R" so that the opposite surface of sheet 30 now forms the undersurface that is exposed for view. Accordingly, where three reel assemblies are provided, it is possible with a single machine to fabricate six different colors of shaped members.

From the foregoing, it may be seen that, as sheet 30 is advanced into the machine, it is first bent into to a trough-shaped configuration by deflecting one, but preferably two of the longitudinal margins by means of guide bars. A first margin is then formed into a selected shaped sidewall while a second margin is gradually elevated to be perpendicular to a central portion engaged by the drive assembly. The various skate assemblies configure the corners, for example, of a gutter, while the pair of forming boxes, each having a plurality of forming stations, configure the shaped sidewall of the gutter. Adjustment in physical dimension may be accomplished by the selected width of a sheet and the positioning of the skate rollers and the co-acting first and second rollers of the forming stations. Finally, the desired length of the shaped member is provided by shearing the formed sheet at the appropriate length by means of shear assembly 500.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. Apparatus adapted to receive an elongated flat sheet of formable material and operative to form a profile along at least one longitudinal margin thereof, comprising:

(a) a frame having an entryway at a first end and an exit at a second end;

(b) a drive assembly supported by said frame and operative to engage a portion of said elongated sheet at a location proximate to the entryway and advance said elongated sheet longitudinally in a downstream direction to discharge said elongated sheet at the exit;

(c) a first guide bar supported by said frame and disposed laterally of said drive assembly, said first guide bar operative to engage a first margin of said elongated sheet as said elongated sheet is advanced in the downstream direction and to deflect said first margin so that said elongated sheet is bent into a trough-shaped cross-section with said first margin positioned in a first forming plane oriented at a first angle with respect to the portion of said elongated sheet engaged by said drive assembly; and (d) at least one forming station located downstream of said first guide bar and including a coacting pair of first and second forming rollers journaled for rotation about first and second axes, respectively, said first and second forming rollers disposed on opposite sides of the first forming plane and configured to deform said first margin into a selected profile.

2. Apparatus according to claim 1 wherein the first angle is within a range of twenty to sixty degrees, inclusively.

3. Apparatus according to claim 1 wherein the first angle is approximately forty degrees.

4. Apparatus according to claim 1 wherein the first and second axes define a roller plane that is oriented perpendicularly to said forming plane.

5. Apparatus according to claim 1 including a plurality of forming stations located downstream of said first guide bar, each of said forming stations including at least one pair of coacting first and second forming rollers journaled for rotation on first and second axes, respectively, that are disposed on opposite sides of the forming plane, said plurality of forming stations operative to sequentially engage said margin of said elongated sheet to deform said margin into a selected profile as said elongated sheet is progressively advanced in the downstream direction.

6. Apparatus according to claim 5 wherein at least some of the first and second forming axes are oriented generally parallel to the forming plane.

7. Apparatus according to claim 5 wherein at least some of said forming stations include a plurality of pairs of coacting first and second forming rollers.

8. Apparatus according to claim 7 wherein some of said first rollers of said plurality are journaled for rotation on a common first axis.

9. Apparatus according to claim 8 wherein some of said second rollers of said plurality are journaled for rotation on a common second axis.

10. Apparatus according to claim 9 wherein at least two of said first rollers located on the common first axis are adjustable first rollers mounted for positioning toward and apart from one another on the common first axis for selected spacing between at least two relative positions so as to selectively vary the profile formed thereby.

11. Apparatus according to claim 10 wherein at least two of said second rollers located on the common second axis are adjustable second rollers mounted for positioning toward and apart from one another on the common second axis for selected spacing between at least two relative positions so as to selectively vary the profile formed thereby.

12. Apparatus according to claim 11 including mechanical linkage interconnecting the first and the second adjustable rollers to link the selected positioning thereof.

13. Apparatus according to claim 5 wherein some of said forming stations are organized into an assemblage supported on a common subframe that is mounted to said frame.

14. Apparatus according to claim 13 including adjustable subframe mounts operative to secure said common subframe to said frame, each of said subframe mounts permitting adjustment in an x axis and a y axis that are transverse to the downstream direction whereby yaw and pitch of said subframe may be selectively varied.

15. Apparatus according to claim 14 wherein each of said subframe mounts permitting rotational adjustment about a z axis perpendicular to the x and y axes whereby roll of said subframe may be selectively varied.

16. Apparatus according to claim 1 wherein said drive assembly engages a central portion of said elongated sheet and including a second guide bar supported by said frame and disposed laterally of said drive assembly on a side thereof opposite said first guide bar, said second guide bar operative to engage a second margin of said elongated sheet as said elongated sheet is advanced in the downstream direction and to deflect said second margin at a second angle so that said central portion of said elongated sheet defines a bottom for the trough-shaped cross-section.

17. Apparatus according to claim 16 wherein said second guide bar is constructed to deflect said second margin at an increasingly larger second angle as said elongated sheet is advanced in the downstream direction.

18. Apparatus according to claim 17 including a skate assembly and a platen roller assembly operative to engage opposite surfaces of said central portion of said elongated sheet as it is advanced in the downstream direction.

19. Apparatus according to claim 1 wherein said drive assembly includes a plurality of drive stations spaced apart from one another in the downstream direction, each said drive station including first and second drive rollers operative to drivingly engage opposite surfaces of said elongated sheet, said first and second drive rollers of each of said drive stations mechanically linked to one another for corresponding counter-rotation, said drive stations mechanically linked to one another whereby said first and second drive rollers correspondingly rotate with one another.

20. Apparatus according to claim 19 including a cooperating skate assembly and platen roller assembly located between longitudinally adjacent ones of said drive stations, each said cooperating skate assembly and platen roller assembly operative to engage the opposite surfaces of said elongated sheet.

21. Apparatus according to claim 1 including opposed entry guide brackets spaced-apart a selected distance from one another and operative to receive opposite side edges of said elongated sheet as it is advanced into the entryway.

22. Apparatus according to claim 21 wherein the distance between said opposed entry guide brackets may be selectively varied.

23. Apparatus according to claim 22 wherein said first guide bar is located immediately downstream of one of said opposed entry guide brackets.

24. Apparatus according to claim 1 adapted to receive a continuous elongated sheet of material and including a reel assembly for mounting a coil of said material to said frame whereby said material may be fed off of said coil and into the entryway.

25. Apparatus according to claim 24 including a shear mechanism located proximately to the exit and operative to cut said elongated sheet into sections of selected length after having the selected profile formed thereon.

26. Apparatus according to claim 24 wherein said reel assembly is adapted to rotatably mount to said frame and includes a U-shaped support frame rotatable between first and second reel positions.

27. Apparatus according to claim 26 including a latch structure for releaseably retaining said U-shaped support frame in a selected one of the first and second reel positions.

28. Apparatus according to claim 27 including a plurality of said reel assemblies disposed longitudinally on said frame.

29. Apparatus adapted to receive an elongated flat sheet of formable material and operative to form a profile along at least one longitudinal margin thereof, comprising:

(a) a frame having an entryway at a first end and an exit at a second end;

(b) a drive assembly supported by said frame and operative to engage a portion of said elongated sheet at a location proximate to the entryway and advance said elongated sheet longitudinally in a downstream direction to discharge said elongated sheet at the exit; and (c) a forming station operative to engage said longitudinal margin to configure said longitudinal margin into a selected profile, said forming station including a coacting first pair of first and second forming rollers and a coacting second pair of first and second forming rollers, said first forming rollers journaled for rotation about respective first axes on a common first axle extending between a pair of support plates, a first one of said first rollers having a fixed relative axial position with respect to said first axle and a second one of said first rollers being axially slideable on said first axle and wherein said first axle has an axial bore at one end thereof sized to matably receive an axial post disposed on and projecting from a first one of said support plates and wherein said first axle is slideably mounted in a second one of said support plates, and said second forming rollers journaled for rotation about respective second axes, said first forming rollers relatively movable with respect to one another in a first axial direction such that a first separation distance therebetween may be selectively varied and said second forming rollers relatively movable with respect to one another in a second axial direction such that a second separation distance therebetween may be selectively varied whereby a selected profile of at least two different dimensions may be selectively formed.

30. Apparatus according to claim 29 including a plurality of said forming stations.

31. Apparatus according to claim 30 wherein some of said forming stations are organized into an assemblage supported on a common subframe that is mounted to said frame.

32. Apparatus according to claim 31 including adjustable subframe mounts operative to secure said common subframe to said frame, each of said subframe mounts permitting adjustment in an x axis and a y axis that are transverse to the downstream direction whereby yaw and pitch of said subframe may be selectively varied.

33. Apparatus according to claim 32 wherein each of said subframe mounts permitting rotational adjustment about a z axis perpendicular to the x and y axes whereby roll of said subframe may be selectively varied.

34. Apparatus according to claim 29 wherein said second rollers are rotatably journaled on a common second axle.

35. Apparatus according to claim 29 including a positioning arm secured to the second one of said first rollers and movable with respect to said second one of said support plates, and including a limit stop on said first axle such that said positioning arm will axially move said second one of said first rollers until said positioning arm engages said limit stop and thereafter said positioning arm will slideably move said first axle with respect to said axial post.

36. Apparatus according to claim 35 including a third one of said first rollers located on a side of said first one of said support plates oppositely of said first and second ones of said first rollers, said third one of said first rollers rotatably journaled with respect to said first one of said support plates.

37. Apparatus according to claim 29 including a skate assembly and a platen roller assembly operative to engage opposite surfaces of a central portion of said elongated sheet as it is advanced in the downstream direction.

38. Apparatus according to claim 29 including opposed entry guide brackets spaced-apart a selected distance from one another and operative to receive opposite side edges of said elongated sheet as it is advanced into the entryway, said entry guide brackets being adjustable to selectively vary the distance therebetween so as to accommodate different widths of said elongated material.

39. Apparatus according to claim 29 adapted to receive a continuous elongated sheet of material and including a reel assembly for mounting a coil of said material to said frame whereby said material may be fed off of said coil and into the entryway.

40. Apparatus according to claim 39 wherein said reel assembly includes a pair of spool supports adapted to engage and support opposite ends of said coil of material, said spool supports adjustably positionable on a reel axle to accommodate different widths of said material.

41. Apparatus according to claim 40 including a detent associated with said spool supports and operative to engage said reel axle to retain at least one of said spool supports in a selected location.

42. Apparatus according to claim 39 including a shear mechanism located proximately to the exit and operative to cut said elongated sheet into sections of selected length after having the selected profile formed thereon.

43. Apparatus adapted to receive an elongated flat continuous sheet of formable material and operative to form a profile along at least one longitudinal margin thereof, comprising:

(a) a frame having an entryway at a first end and an exit at a second end;

(b) a drive assembly supported by said frame and operative to engage a portion of said elongated sheet at a location proximate to the entryway and advance said elongated sheet longitudinally in a downstream direction to discharge said elongated sheet at the exit;

(c) a plurality of forming stations each including a coacting pair of first and second forming rollers journaled for rotation about first and second axes, respectively, said first and second forming rollers disposed on opposite sides of a first forming plane and configured to deform said first margin into a selected profile, at least some of said forming stations are organized into an assemblage supported on a common subframe that is mounted to said frame; and (d) adjustable subframe mounts operative to secure said common subframe to said frame, each of said subframe mounts permitting adjustment in an x axis and a y axis that are transverse to the downstream direction whereby yaw and pitch of said subframe may be selectively varied.

44. Apparatus according to claim 43 wherein each of said subframe mounts permitting rotational adjustment about a z axis perpendicular to the x and y axes whereby roll of said subframe may be selectively varied.

* * * * *